US008025167B2

(12) United States Patent
Schneider et al.

(10) Patent No.: US 8,025,167 B2
(45) Date of Patent: Sep. 27, 2011

(54) CRANE CONTROL, CRANE AND METHOD

(75) Inventors: Klaus Schneider, Hergatz (DE); Oliver Sawodny, Stuttgart (DE); Jörg Neupert, Korntal-Münchingen (DE)

(73) Assignee: Liebherr-Werk Nenzing GmbH, Nenzing (AT)

( * ) Notice: Subject to any disclaimer, the term of this patent is extended or adjusted under 35 U.S.C. 154(b) by 0 days.

(21) Appl. No.: 12/152,717

(22) Filed: May 16, 2008

(65) Prior Publication Data

US 2009/0008351 A1 Jan. 8, 2009

(30) Foreign Application Priority Data

May 16, 2007 (DE) ..... 10 2007 023 027
Aug. 21, 2007 (DE) ..... 10 2007 039 408

(51) Int. Cl.
*B66C 13/06* (2006.01)

(52) U.S. Cl. ..... 212/273; 212/276

(58) Field of Classification Search ..... 212/273, 212/276

See application file for complete search history.

(56) References Cited

U.S. PATENT DOCUMENTS

| | | | | |
|---|---|---|---|---|
| 3,904,156 | A * | 9/1975 | Smith | 244/118.1 |
| 4,471,877 | A * | 9/1984 | Whitly | 212/273 |
| 4,932,541 | A * | 6/1990 | Belsterling | 212/308 |
| 5,667,186 | A * | 9/1997 | Luber et al. | 248/550 |
| 5,729,339 | A * | 3/1998 | Park et al. | 356/152.2 |
| 6,496,765 | B1 * | 12/2002 | Robinett et al. | 701/50 |
| 6,496,766 | B1 * | 12/2002 | Bernold et al. | 701/50 |
| 6,826,452 | B1 * | 11/2004 | Holland et al. | 700/245 |
| 7,489,098 | B2 * | 2/2009 | Harris et al. | 318/565 |
| 2004/0164041 | A1 | 8/2004 | Sawoody et al. | |
| 2008/0019815 | A1 * | 1/2008 | Harris et al. | 414/563 |

FOREIGN PATENT DOCUMENTS

| | | |
|---|---|---|
| DE | 275035 | 1/1990 |
| DE | 4032332 | 4/1992 |
| DE | 19842436 | 3/2000 |
| DE | 10042699 | 4/2002 |
| EP | 1326798 | 4/2006 |
| JP | 04223993 | 8/1992 |

* cited by examiner

*Primary Examiner* — Thomas J. Brahan
(74) *Attorney, Agent, or Firm* — Dilworth & Barrese, LLP.

(57) ABSTRACT

The present invention shows a crane control of a crane which includes at least one cable for lifting a load, wherein at least one sensor unit is provided for determining a cable angle relative to the direction of gravitational force. Furthermore, there is shown a crane control for driving the positioners of a crane which includes at least one first and one second strand of cables for lifting the load, with a load oscillation damping for damping spherical pendular oscillations of the load, wherein first and second sensor units are provided, which are associated to the first and second strands of cables, in order to determine the respective cable angles and/or cable angular velocities, and the load oscillation damping includes a control in which the cable angles and/or cable angular velocities determined by the first and second sensor units are considered. Furthermore, a corresponding crane and a method are shown.

40 Claims, 15 Drawing Sheets

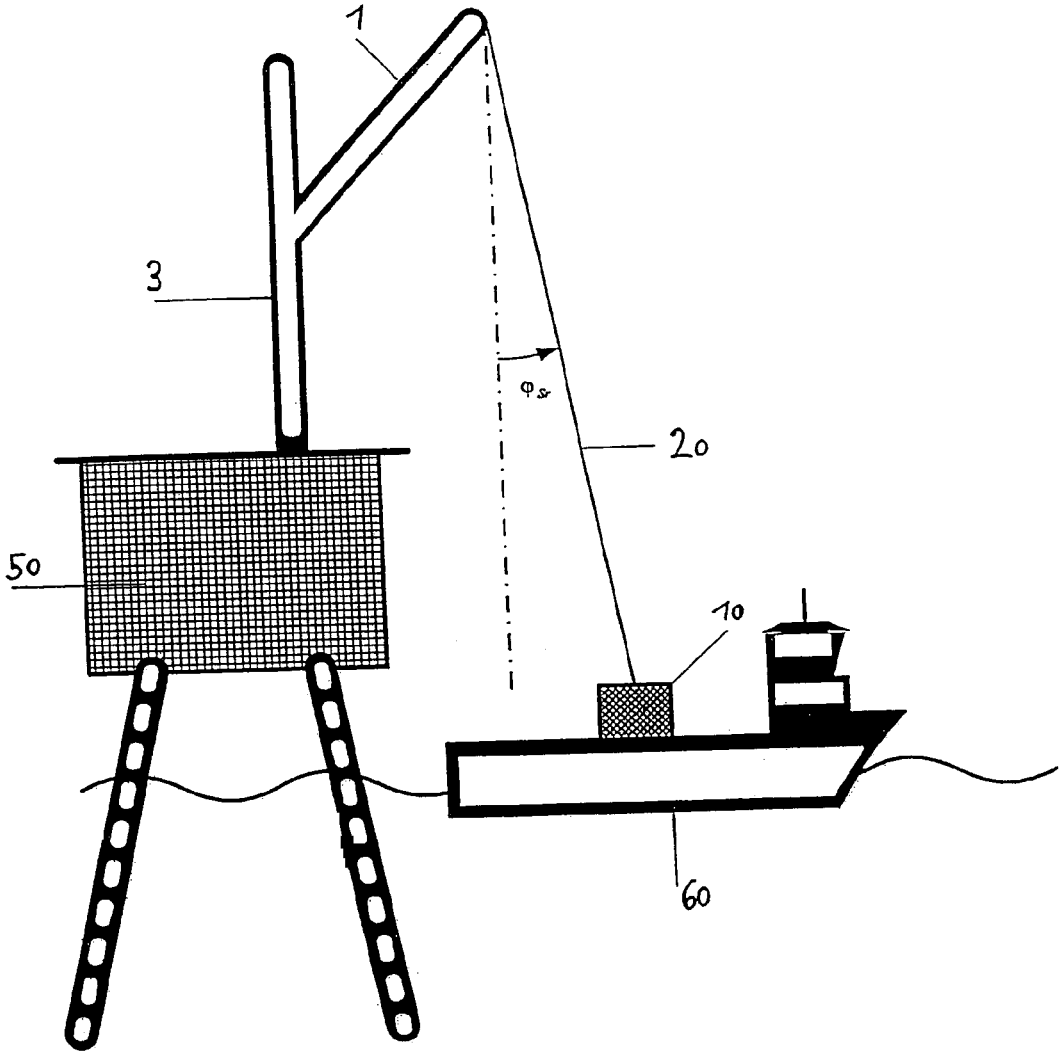
Fig. 4a
Fig. 4b
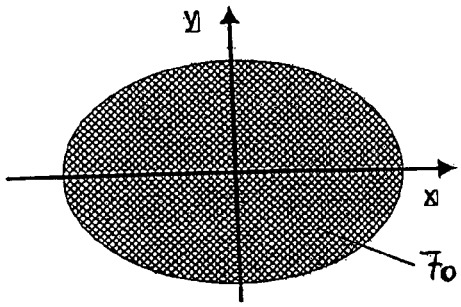

CRANE CONTROL, CRANE AND METHOD

BACKGROUND OF THE INVENTION

The present invention relates to a crane control of a crane which includes at least one cable for lifting a load. Furthermore, the present invention relates to a further configuration of the crane control of a crane which includes at least one first and one second strand of cables for lifting a load. The crane control drives the positioners of the crane. In particular, the crane is a boom crane which has a boom to be swivelled about a horizontal axis, which is hinged to a tower rotatable about a vertical axis. For this purpose, a luffing gear and a slewing gear are provided as positioners. The cable for lifting the load runs over the tip of the boom, in particular over one or more deflection pulleys arranged there, so that the load can be moved in tangential direction by slewing the tower and in radial direction by luffing up the boom. In the embodiment of the invention with at least one first and one second strand of cables, both strands of cables extend from the tip of the boom to a suspension element such as a hook. The length of the cable can be adjusted by a corresponding drive, in order to move the load in vertical direction. In particular, the crane control of the invention generally relates to rotary cranes as well as mobile harbour cranes, ship cranes, off-shore cranes, truck cranes and crawler cranes.

From DE 100 64 182 and DE 103 24 692, whose entire contents form part of the present application, crane controls are known, whose control and automation concepts prevent the pendular movement of the load on the cable during a movement of the crane.

From DE 100 29 579 and DE 10 2006 033 277, whose contents likewise form part of the present application, there are furthermore known crane controls which prevent a rotary oscillation of the load on the cable.

In the above-mentioned crane controls, gyroscope units are used for determining the load oscillation, which are arranged in the hook of the crane and determine the angular velocity of the cable. The cable angle is determined via an observer circuit which integrates the movement of the cable. To be able to compensate the resulting offset, a freely swinging pendulum is assumed, whose rest position corresponds to a perpendicular cable angle. Such procedure is quite useful for damping the cable oscillation, as for this purpose the movements of the cable must be monitored above all when the load is swinging freely on the cable. However, a determination of the absolute alignment of the cable, in particular before the load can swing freely, neither is provided nor possible in the known crane controls. Furthermore, known sensor arrangements and crane controls have had the disadvantage that disturbing influences such as the cable field twisting were not taken into consideration in the load oscillation damping for damping the spherical pendular oscillations of the load.

Known systems, however, as they are used e.g. in cranes with a trolley merely movable in horizontal direction, and which employ measurement camera systems for determining the absolute cable angle, cannot be used in particular in boom cranes. Measurement camera systems always must be arranged directly behind the cable checkpoint, in order to be able to determine the cable angle. In the case of boom cranes, however, in which the cable is movably guided over a deflection pulley arranged at the boom head, no cable checkpoint does exist, as the cable exit point likewise changes with the cable angle. Measurement pick-ups, which mechanically determine the cable angle relative to the boom, are just as useless for measuring the absolute cable angle, as they operate inaccurately, first of all, and in addition lead to wrong results in the case of a deformation of the crane. Moreover, all these systems always only determine the cable angle relative to the boom, and thus would only indirectly be useful for determining the absolute cable angle, so that such solutions so far have completely been omitted.

Before hoisting or at the beginning of hoisting, the crane operator therefore must still align the crane manually and at sight, such that the cable is aligned substantially perpendicular. Especially with the great distance from the load, however, this is often possible only with great difficulty, so that deviations of the cable angle from the plumb line are obtained, which lead to undesired oscillations when lifting the load. The same problems arise when due to an imbalance of the load the cable is aligned perpendicularly before hoisting, but when lifting the load the cable angle is changed by the movement of the center of gravity of the load below the load suspension point. The yielding of the crane structure under the load when lifting the load also can change the cable angle unintentionally. Off-shore cranes additionally involve the problem that the cable angle can be changed by a relative movement of a ship carrying the load with respect to the off-shore crane.

SUMMARY OF THE INVENTION

Therefore, it is the object of the present invention to provide a crane control which provides for an easier and safer alignment of the crane in particular before and while lifting the load. Furthermore, it is the object of the present invention to provide for an improved damping of the spherical pendular oscillations of the load.

In accordance with the invention, this object is solved by a crane control according to the description herein. In accordance with the invention, the same includes a sensor unit for determining a cable angle relative to the direction of gravitational force. By means of this sensor unit, the cable angle can directly be determined relative to the direction of gravitational force, so that the perpendicular alignment of the cable is simplified considerably. Safety during hoisting also is increased thereby.

The sensor unit usually includes an element which is aligned under the influence of gravitational force and by means of which the angle of the cable can be determined relative to the direction of gravitational force. In particular, any kind of electric spirit level can be used here. In the most simple configuration, the sensor unit merely can determine whether or not the cable is aligned perpendicularly. In more expensive configurations, the direction of the deviation from the plumb line and in further configurations the value of the deviation from the plumb line can also be determined.

Advantageously, the cable angle can be determined by the sensor unit in at least one direction relative to the direction of gravitation, e.g. in radial or tangential direction, in order to be able to determine and possibly compensate a deviation of the cable angle from the plumb line in this direction. Advantageously, the cable angle is determined both in tangential and in radial direction, as an actually perpendicular alignment of the cable only is possible in this way. For this purpose, the sensor unit advantageously includes at least two sensors, which each serve the determination of the radial or tangential cable angle relative to the direction of gravitational force.

By means of such sensor unit, a precise alignment of the crane becomes possible when lifting the load, so that the cable is aligned perpendicularly. The sensor unit likewise can be used for monitoring and protecting functions.

Furthermore advantageously, beside the sensor unit for determining a cable angle relative to the direction of gravitational force at least one gyroscope unit is provided for measuring a cable angular velocity. In particular, this gyroscope unit can furthermore be used for damping oscillations with a freely swinging load, for which purpose the sensor unit for determining the cable angle relative to the direction of gravitational force usually can supply data which are not accurate enough. The alignment of the crane then can initially be effected on the basis of the sensor unit for determining the cable angle relative to the direction of gravitational force, until the load is freely hanging on the cable. Thereupon, the automatic cable oscillation damping can be actuated, which operates on the basis of the gyroscope unit.

The gyroscope unit measures the cable angular velocity in at least one direction, e.g. in radial or tangential direction. Advantageously, however, both the tangential and the radial cable angular velocities are determined, for which purpose the gyroscope unit advantageously includes at least two correspondingly arranged gyroscopes.

If the crane includes at least two strands of cables for lifting the load, the crane control advantageously comprises at least two sensor units for determining the cable angles relative to the direction of gravitational force, which are associated to different strands of cables. In this way, a cable field twisting can be considered, which corresponds to a rotation of the load. If only one sensor unit would be used for a plurality of strands of cables, a cable field twisting would lead to distorted measurement values.

In particular, the cable field twisting and hence the twisting of the load can be determined by the at least two sensor units. This provides for also compensating the cable field twisting before the beginning of hoisting, e.g. by rotating the load suspension means relative to the load.

Furthermore advantageously, if the crane includes at least two strands of cables for lifting the load, at least two gyroscope units are provided for measuring the cable angular velocities, which are associated to different strands of cables. Thus, the cable field twisting can for instance also be considered when actuating the oscillation damping.

Furthermore advantageously, the sensor unit and/or the gyroscope unit are arranged on a cable follower, which is connected with a boom of the crane in particular via a cardan joint, and which is guided on the cable. The cable follower preferably is connected with the boom head of the crane by the cardan joint and follows the movements of the cable, on which it is guided by pulleys. By measuring the movement of the cable follower, the movements of the cable can thus be determined.

If the crane includes at least two strands of cables for lifting the load, furthermore advantageously at least two cable followers are provided, which are associated to different strands of cables. Since the hook of the crane mostly is suspended on several strands of cables, cable field twistings thus can also be considered.

Furthermore advantageously, the crane control of the invention includes a display unit for indicating a deviation resulting from the measured cable angle, in particular for indicating a cable angle relative to the direction of gravitational force and/or a resulting horizontal deviation of the load. By means of this indication, the alignment of the cable in a perpendicular position is considerably facilitated for the crane operator.

Advantageously, the display optically and/or acoustically indicates a perpendicular position of the cable. As a result, it is possible for the crane operator to align the cable correspondingly.

Furthermore advantageously, the display furthermore indicates the direction in which the cable deviates from the plumb line. Furthermore advantageously, the display additionally indicates the absolute value of the deviation. What is conceivable here is e.g. a graphic display, in which the angle of the cable relative to the direction of gravitational force and furthermore advantageously the maximum admissible cable angles are indicated. Alternatively or in addition, the horizontal deviation of the load from the position at which the load would be located in the case of a perpendicular cable position can also be indicated, advantageously together with the maximum admissible horizontal deviation. Thus, the crane operator can work with familiar distance data and can align the crane more easily.

Furthermore advantageously, a warning means is provided, which warns the crane operator when an admissible range of values for a deviation resulting from the measured cable angle, in particular for the cable angle relative to the direction of gravitational force and/or for the horizontal deviation of the load is exceeded, in particular by an optical and/or acoustic signal. When the admissible range of values is exceeded, the crane operator thus can react and avoid damages to the crane structure or accidents. The crane operator can for instance stop the movement of the crane when the admissible range of angles is exceeded, or, in the case of an off-shore crane, in which the load present on a ship, for instance, is moved away from the off-shore crane by a relative movement of the ship relative to the crane, avoid an overload by partially releasing the cable or the slewing gears of the crane.

Furthermore advantageously, a protection means, in particular an overload protection, is provided, which automatically intervenes in the control of the crane when an admissible range of values for a deviation resulting from the measured cable angle, in particular for the cable angle relative to the direction of gravitational force and/or for the horizontal deviation of the load is exceeded, so as to prevent in particular an overload of the crane. In particular, the cable angle relative to the direction of gravitational force can be included in the automatic load moment limitation of the crane. The safety of operation thereby is increased considerably, as known load moment limitations could not consider this parameter and the loads occurring as a result of an excessive inclination of the cable had to be taken into consideration via the other measurement pick-ups alone.

Advantageously, the overload protection automatically stops the movement of the crane. It thereby is prevented that an excessive inclination of the cable leads to an overload of the crane structure. Likewise, the protection means not only can prevent an overload of the crane, but also accidents, in that e.g. lifting the load is automatically prevented when the admissible range of values is exceeded, in order to avoid too much swinging when the load gets free.

In particular in the case of an off-shore crane, the overload protection can at least partly enable the movement of the crane and/or the cable, wherein release advantageously is effected in a controlled way with a certain counterforce. For instance, if the hook of the crane gets entangled with a ship which is driven away from the off-shore crane, e.g. the cable or the slewing movement of the crane thus can be released in a controlled way, in order to prevent an overload of the crane. The sensor unit for determining a cable angle relative to the direction of gravitational force here provides a very reliable overload protection, whereas known overload protections here were dependent on a cable force sensor alone, which can, however, hardly distinguish between a case of overload and a case of load.

Furthermore advantageously, the crane control of the invention, in particular the warning means and/or the overload protection, additionally evaluates data of a cable force sensor. This allows to check the data from the sensor unit for determining the cable angle relative to the direction of gravitational force, so that in particular in the case of an automatic intervention of the crane control in the movement of the crane additional safety is provided due to a redundancy.

If the crane includes at least two strands of cables for lifting the load, the cable field twisting thereof advantageously is determined. Since in the case of a pure twisting of the load, the outer cables each are deflected in opposite directions, without the load being deflected from the plumb line, this cable field twisting advantageously is considered when determining the actual cable angle. As a result, the cable angle used in the display, the warning means and/or the overload protection corresponds to the actual deflection of the load relative to the direction of gravitational force, so that an oscillation of the load can effectively be prevented and possible cable field twistings do not lead to wrong values.

Advantageously, the crane control of the invention comprises a display unit for indicating the cable field twisting. Thus, the cable field twisting itself likewise can be indicated on the display, so that it can be compensated by driving a corresponding rotor unit on the load suspension device. The cable field twisting also can advantageously be considered in the drive of the warning means and of the overload protection.

Therefore, a warning means advantageously is provided in the crane control of the invention, which warns the crane operator when an admissible range of values for the cable field twisting is exceeded, in particular by an optical and/or acoustic signal. The crane operator thus is warned about a rotary pendular movement of the load when lifting with a twisted cable field.

In the crane control of the invention, there is also advantageously provided a protection means, in particular an antitwist protection, which automatically intervenes in the control of the crane when an admissible range of values for the cable field twisting is exceeded. For example, lifting the load with too much twist of the cable field can automatically be prevented.

Furthermore advantageously, the crane control of the invention includes an automatic load oscillation damping. In particular, the movement of the crane thereby can be driven such that during a movement of the crane, a pendular movement of the freely swinging load is prevented. The sensor unit for determining the cable angle relative to the direction of gravitational force can be used for the perpendicular alignment of the cable at the beginning of hoisting, whereas the load oscillation damping is started when the load is freely hanging on the cable. Thus, a pendular movement of the load during lifting can be prevented by the proper alignment of the cable, and a pendular movement of the load during its movement in horizontal direction by the load oscillation damping.

Advantageously, load oscillation damping is based on the data of at least one gyroscope unit. Since the cable angular velocity can be determined by means of a gyroscope, the same is particularly suitable for use in load oscillation damping.

Advantageously, the sensor unit is used for determining the cable angle relative to the direction of gravitational force for monitoring and/or calibrating the gyroscope unit. In particular when hoisting is started with oblique cable position and supported load, the load oscillation damping, which usually proceeds from a freely swinging load, would otherwise start with wrong values. The sensor units or gyroscope units can also be used for mutual monitoring, in order to detect malfunctions.

Advantageously, there is furthermore provided a function for automatically aligning the crane, by means of which the cable is aligned perpendicular over the load. Hence, the crane operator no longer must align the crane manually, e.g. by means of the display, but this is done automatically upon a corresponding request of the crane operator via a control unit. Advantageously, a safety function is provided, which cooperates for instance with a cable force sensor, in order to prevent an uncontrolled movement of the crane in the case of a malfunction of the sensor unit for determining the cable angle relative to the direction of gravitational force.

Furthermore advantageously, there is also provided a function for automatically aligning the crane, by means of which cable field twisting is compensated. The same advantageously drives a rotor unit on the load suspension device, e.g. on the spreader, by means of which the part of the load suspension device connected with the cables can be rotated relative to the load.

Furthermore advantageously, the crane control of the invention includes a memory for storing load data on the basis of the cable angle, which are used for service life calculation and/or documentation of e.g. improper use. Such machine data acquisition of the cable position for load collective determination and for documentation thus provides for a more accurate service life calculation and hence for an increased safety at reduced cost.

The present invention furthermore comprises a method for driving a crane, which includes at least one cable for lifting a load. In accordance with the invention, the method is characterized in that there is determined a cable angle relative to the direction of gravitational force. Such determination of a cable angle relative to the direction of gravitational force results in the advantages described already in detail with respect to the crane control. Advantageously, the radial and/or tangential cable angles relative to the direction of gravitational force are determined.

In particular, the alignment of the crane before and while lifting the load is considerably simplified thereby. Advantageously, beside a cable angle, which corresponds to the actual deflection of the load against the plumb line, the cable field twisting is determined in addition, when several strands of cables are used for lifting the load. For this purpose, the cable angles of at least two strands of cables relative to the direction of gravitational force are determined. From these data, both the cable angle, which corresponds to the deflection of the load, and the cable field twisting, which corresponds to the twisting of the load, can then be determined.

Advantageously, the cable is brought into a perpendicular alignment before lifting the load. In this way, it can be prevented that due to an inclination of the cable when lifting the load the same slips to the side, is twisted in an uncontrolled way by unequally resting on the support or already performs a pendular movement when being lifted. The perpendicular alignment of the load can be effected e.g. by the crane operator based on the inventive indication of the cable angle relative to the direction of gravitational force. It is likewise conceivable that this alignment is automatically effected by the crane control as described above.

Furthermore advantageously, cable field twisting is brought to zero before lifting the load, in order to avoid a rotation of the load when lifting the same. This is effected e.g. by correspondingly rotating the load on the load suspension device by means of a rotor arrangement.

During the hoisting operation, deviations of the cable angle from the plumb line can also be obtained as a result of different effects. Advantageously, a deviation of the cable angle from the plumb line therefore is compensated while lifting the load. For this purpose, the cable angle relative to the direction of gravitational force advantageously is determined while lifting the load, so that possibly occurring deviations can be compensated during the hoisting operation.

Advantageously, an imbalance of the load is determined when lifting the load by determining the occurring deviation of the cable angle from the plumb line. In the case of an imbalance of the load, i.e. when the center of gravity of the load is not below the load suspension point, the load suspension point initially moves over the center of gravity when lifting the load, so that the cable angle is changed. By means of this change of the cable angle, the imbalance of the load can be determined and possibly be compensated. Such imbalance of the load can likewise be indicated, so that it can be compensated by the crane operator. It is also conceivable to automatically compensate such imbalance.

Such compensation of the imbalance of the load, by means of which the center of gravity of the load is moved below the load suspension point with unchanged alignment of the load, thus provides for moving the containers within the guideways in the ship, without the same getting canted by tilting.

If such compensation of the imbalance of the load is not possible, or if canting of the load is unproblematic, the inclination of the cable due to the imbalance of the load when lifting the load can alternatively also be compensated by a movement of the crane. This can also be effected either manually by the crane operator, e.g. by means of a display, or automatically.

Due to the loading of the crane structure when lifting the load, the same can be deformed, so that the cable angle is changed, even without the load being moved. In accordance with the invention, the yielding of the crane structure under the load therefore advantageously is determined when lifting the load by determining the deviation of the cable angle from the plumb line and/or the inclination of the cable due to the yielding of the crane structure is compensated by a movement of the crane. Determining the deviation or compensating this deviation can in turn be effected by the crane operator, e.g. by means of a display, or automatically.

Furthermore advantageously, the crane structure is protected by countermeasures when an admissible range of values for a deviation resulting from the measured cable angle, in particular for the cable angle relative to the direction of gravitational force and/or for the horizontal deviation of the load is exceeded. In particular, the movement of the crane can be stopped, in order to avoid an overload.

In particular when driving an off-shore crane, the countermeasures advantageously comprise an at least partial release of the crane movements and/or of the cable, in order to prevent an overload of the crane for instance when the load suspension means gets canted with a ship which moves away from the off-shore crane.

The countermeasures can be taken either by the crane operator, who for this purpose is advantageously warned by a warning function, or automatically by a corresponding automatic overload protection.

The present invention furthermore comprises a crane control of a crane which includes at least one cable for lifting a load, for performing one of the methods described above. In particular, the crane control advantageously is designed such that the methods described above are at least partly performed automatically.

Furthermore advantageously, the present invention comprises a crane, in particular a mobile harbour crane, a ship crane or an off-shore crane, which includes a cable for lifting a load and is equipped with a crane control as described above. The invention also comprises corresponding boom and/or rotary cranes as well as truck cranes and crawler cranes. Quite obviously, the same advantages as described already in conjunction with the crane control are obtained for such a crane.

Beside the above-described configuration of the present invention with a sensor unit for determining a cable angle relative to the direction of gravitational force, the present invention furthermore comprises a crane control which can also be used advantageously without such sensor unit in cranes which include at least one first and one second strand of cables for lifting the load.

Such crane control is shown herein. The crane control of the invention is used for driving the positioners of a crane which includes at least one first and one second strand of cables for lifting a load, wherein the crane control includes a load oscillation damping for damping spherical pendular oscillations of the load. In accordance with the invention, first and second sensor units now are provided, which are associated to the first and second strands of cables, in order to determine the respective cable angles and/or cable angular velocities of the first and second strands of cables. Furthermore, the load oscillation damping includes a control in which the cable angles and/or cable angular velocities determined by the first and second sensor units are considered.

As compared to known arrangements, in which a sensor unit is mounted on a hook of the crane or only on a cable, numerous advantages are obtained thereby: on the one hand, a redundancy of this safety-relevant element is obtained, so that in the case of a failure of one sensor unit, the cable angle still can be measured via the second sensor unit. It is also possible to detect sensor errors. It is furthermore possible to achieve a reduction of noise by forming a difference of the measured values and to implement a compensation of torsion by evaluation algorithms, i.e. the consideration of a cable field twisting when determining the actual deflection angle of the load.

The positioners driven by the crane control advantageously include the slewing gear for slewing the crane and/or the luffing gear for luffing up the boom. By means of the corresponding control of this drive via the load oscillation damping, spherical oscillations of the load on the cable can thus be prevented.

Advantageously, the first and second sensor units each include a gyroscope unit. The gyroscopes measure the cable angular velocity, wherein advantageously two gyroscopes are provided, in order to measure the cable angular velocity both in radial and in tangential direction. Gyroscopes are particularly useful to meet the requirements of the control of the load oscillation damping.

Furthermore advantageously, the first and second sensor units of the present invention each are arranged in a cable follower. The cable follower follows the movement of that strand of cables to which it is associated. Then, the sensor unit in turn measures the movement of the cable follower, from which the movement of the strand of cables can be determined. By means of the cable followers, a particularly accurate and reliable cable angle measurement is obtained.

Advantageously, the cable followers each are connected with the boom of the crane via a cardan joint and follow the movement of the strand of cables to which they are associated. However, the connection of the cable followers via a cardan joint advantageously merely serves the mechanical connection and guidance of the cable follower, while the sensor units determine the movement of the cable followers via the gyroscope units in accordance with the invention.

Advantageously, the data measured by the first and second sensor units are evaluated by first and second observer circuits. Such observer circuits are used to suppress offsets and disturbing influences, such as e.g. cable harmonics. The observer circuits serve the integration of the cable angular velocities measured by the gyroscopes and provide for a reliable determination of the cable angles.

Furthermore advantageously, a compensation of the data measured by the first and second sensor units with respect to the mounting angle of the sensor units and the slewing angle of the crane is effected in accordance with the invention. Disturbing influences caused by wrong assembly thereby can be compensated by the corresponding software. If the planes of sensitivity of the gyroscopes used are not exactly located in tangential or radial direction, but are tilted due to wrong assembly, the sensors proportionally measure also the slewing speed of the crane. This is taken into consideration by the compensation in accordance with the invention.

Furthermore advantageously, sensor errors are detected in the crane control of the invention by a comparison of the data measured by the first and second sensor units. In the case of a failure of one of the sensor units, the angular velocity still is detected by the other sensor unit. Hence, the basic function of the crane control can still be ensured. By forming a difference of the angle signals of both sensor units in the respective directions, a sensor error can still be detected when a threshold value is exceeded. When a sensor error occurs, the crane can immediately be brought into a safe condition.

Furthermore advantageously, the torsional oscillation of the cable field is taken into consideration in the load oscillation damping by forming an average from the cable angles and/or cable angular velocities determined by the first and second sensor units. When using only one sensor unit, such cable field twisting would influence the control used for damping the spherical pendular oscillation of the load. If a torsional oscillation of the cable field occurs in the crane control of the invention, the sensor units on the two cable followers exactly measure an opposite parasitic oscillation both in tangential and in radial direction. By forming an average, the influence of this torsional oscillation can, however, be eliminated in accordance with the invention.

Furthermore advantageously, the control of the crane control of the invention is non-linear. Such non-linear control is particularly advantageous, as in particular in the case of boom cranes the entire system of crane, positioners such as hydraulic cylinders and load is non-linear and thus considerable errors occur in the case of a purely linear control. On the other hand, the entire control path of non-linear control and the non-linear behavior of the crane in turn provides a linear path in accordance with the invention, so that driving the system is simplified considerably.

Furthermore advantageously, the control is based on the inversion of a physical model of the movement of the load in dependence on the movements of the positioners. Advantageously, this physical model is a non-linear model, so that the inventive non-linear control is obtained from its inversion. The combination of the inverted physical model and the actual movement of the load in dependence on the movement of the positioners then again provides the linear path described above. Input variables of the physical model include the state vector of the crane. On the basis of these input variables, the non-linear model then indicates the movement of the load as an output variable. Due to the inversion of such system, the movement of the load serves as an input variable, in order to drive the positioners of the crane.

Furthermore advantageously, the load oscillation damping of the invention includes a path planning module, which specifies desired trajectories for the control. These desired trajectories specify the movements to be performed by the load and then in particular serve as input variables of the control when using an inverted model. By means of the non-linear control, a particularly simple implementation of the path planning module is obtained, as the same must merely specify desired trajectories for the linear system of non-linear control and non-linear crane behavior. In this way, an extremely fast crane control with an excellent response to the specifications entered by the crane operator by means of input elements can be achieved.

Advantageously, the current system condition of the crane, in particular the position of the boom and/or the cable angles and/or cable angular velocities determined by the first and second sensor units are included in the path planning module as input variables. In particular, the position of the boom is important here, as for instance the maximum radial velocity to be achieved depends on the same. Advantageously, the cable angles and/or cable angular velocities determined by the first and second sensor units also are included in the path planning module as input variables. This additional control circuit thus provides for an even more accurate path planning in consideration of the actual cable angle and/or the actual cable angular velocity.

Furthermore advantageously, restrictions of the system are considered in the path planning module of the invention when generating the desired trajectories. It thereby is prevented that the reference input variables calculated from the specifications of the crane operator violate the actuating variable restrictions of the system, such as the maximum velocity. In particular when the current system condition of the crane is also included in the path planning module as input variable, restrictions of the system thus can also be considered, which depend on this system condition. For instance, the maximum possible radial velocity depends on the position of the boom.

Furthermore advantageously, the generation of trajectories in accordance with the invention is based on an optimal control. In accordance with the invention, such optimal control can particularly easily be implemented on a real-time basis, as the non-linear control of the invention allows a particularly simple implementation of the path planning module.

Furthermore advantageously, the path planning module of the invention employs an increasing length of the calculation intervals for the prediction within the time horizon. By using such non-equidistant checkpoints for the prediction it is likewise possible to considerably reduce the calculation time. For the near future, short intervals are chosen between the checkpoints, whereas larger intervals are chosen for the distant future, so that on the whole a considerably reduced number of calculation steps is obtained.

Furthermore advantageously, the position and velocity of the boom head also are included in the control of the load oscillation damping. In the crane control of the invention, control circuits therefore are obtained both for the position and the velocity of the boom head and also for the cable angle and/or the angular velocity of the cable.

The second embodiment of the present invention with the use of two sensor units, which each are associated to different cable strands of the crane, so far has been described independent of the first embodiment with one sensor unit for determining a cable angle relative to the direction of gravitational force. In accordance with the invention, protection was claimed independently for both embodiments.

In a particularly advantageous embodiment, however, both embodiments of the present invention are combined. Furthermore advantageously, the system of the invention with two sensor units has one or more of the features described above with reference to the embodiment of the invention with one sensor unit for determining a cable angle relative to the direction of gravitational force.

The present invention furthermore comprises a crane for lifting a load, with positioners for moving the crane and the load and with a crane control for driving the positioners, wherein the crane control includes a load oscillation damping for damping spherical pendular oscillations of the load, and wherein the crane includes at least two strands of cables for lifting the load. In accordance with the invention, two sensor units are provided, which are associated to the two strands of cables, in order to determine the respective cable angles and/or cable angular velocities. Furthermore, the load oscillation damping includes a control, in which the cable angles and/or cable angular velocities determined by the two sensor units are considered. Such crane provides the same advantages as already described above with respect to the crane control in accordance with the invention.

Furthermore, the crane in accordance with the invention includes a crane control as described above.

Furthermore advantageously, the crane in accordance with the invention includes a slewing gear for slewing the crane and/or a luffing gear for luffing up a boom as positioners which are driven by the crane control. By means of the corresponding control of this drive via the load oscillation damping, spherical oscillations of the load on the cable can thus be prevented.

The present invention furthermore comprises a method for driving the positioners of a crane which includes at least one first and one second strand of cables for lifting the load, wherein spherical pendular oscillations of the load are damped by a load oscillation damping. In accordance with the invention, the cable angles and/or cable angular velocities of the first and second strands of cables are determined via first and second sensor units, which are associated to the first and second strands of cables, and are included in the control of the load oscillation damping. By means of this method, the same advantages are obtained as described above with respect to the crane control.

Advantageously, a compensation of the data measured by the first and second sensor units with respect to the mounting angle of the sensor units and the slewing angle of the crane is effected in accordance with the invention. In this way, deviations of the mounting angle of the sensor units from an exact radial or tangential alignment can be compensated.

Furthermore advantageously, sensor errors are detected by a comparison of the data measured by the first and second sensor units. By the inventive use of two sensor units, which are associated to the respective strands of cables, the redundancy obtained thereby can be utilized.

Furthermore advantageously, the torsional oscillation of the cable field is furthermore taken into consideration in the load oscillation damping by forming an average from the cable angles and/or cable angular velocities determined by the first and second sensor units. In the load oscillation damping it can thus be considered that there are also torsional oscillations of the cable field, which influence the data of the sensor units.

Advantageously, the method of the invention is performed with a crane control as described above.

BRIEF DESCRIPTION OF THE DRAWINGS

The present invention will now be explained in detail with reference to embodiments and the drawings, in which:

FIG. 4*a*: shows an embodiment of an off-shore crane in accordance with the invention with a corresponding deflection of the cable from the plumb line due to a movement of a ship, and FIG. 4*b*: shows the graphic representation of an admissible range of cable angles.

DESCRIPTION OF THE PREFERRED EMBODIMENTS

Figure 0A:
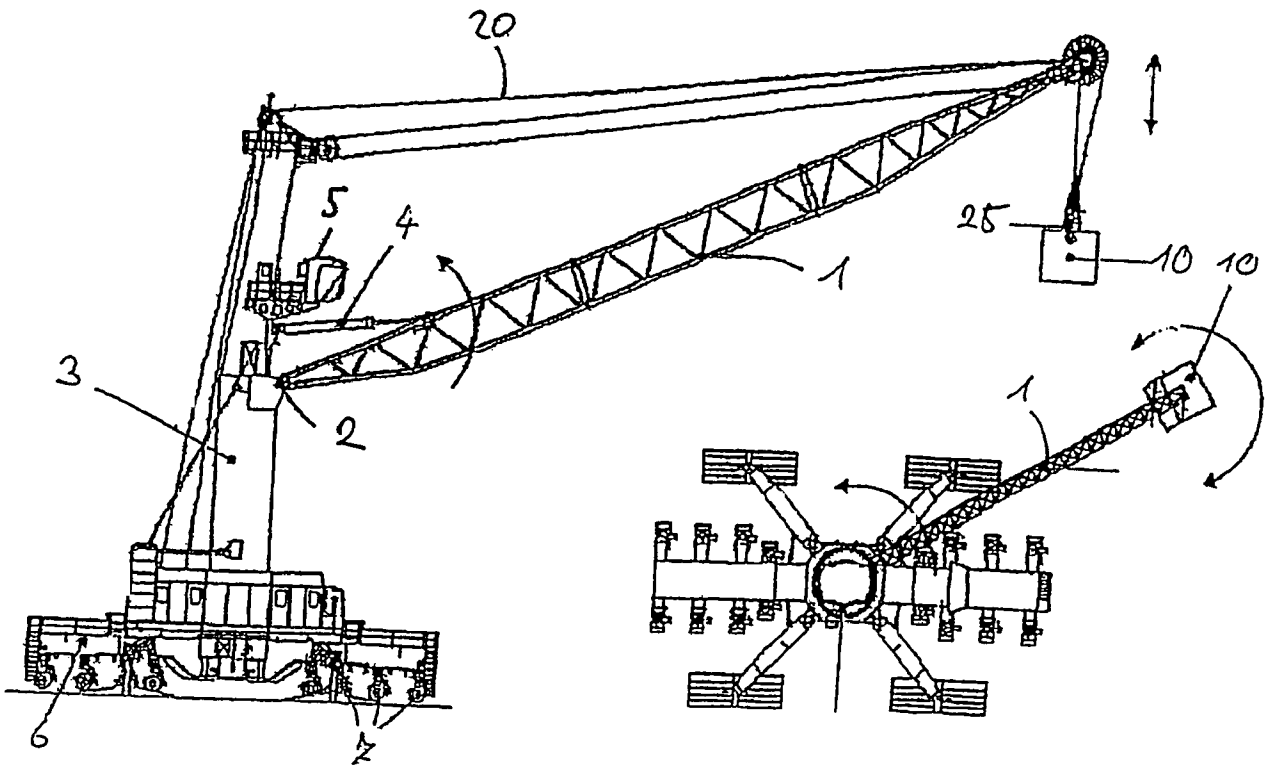
FIG. 0*a*: shows an embodiment of a mobile harbour crane in accordance with the invention.

FIG. 0*a* shows an embodiment of a boom crane in accordance with the invention, here of a mobile harbour crane, as they are frequently used for performing freight handling operations in harbours. Such boom cranes can have load capacities of up to 140 t and a cable length of up to 80 m. The embodiment of the crane in accordance with the invention comprises a boom 1, which can be swivelled up and down about a horizontal axis 2 with which it is hinged to the tower 3. The tower 3 can in turn be slewed about a vertical axis, whereby the boom 1 is also slewed. For this purpose, the tower 3 is rotatably mounted on an undercarriage 6, which can be moved by wheels 7. For slewing the tower 3, non-illustrated positioners are provided, and for luffing up the boom 1 the actuator 4. The cable 20 for lifting the load 10 is guided over a deflection pulley at the boom head, with the length of the cable 20 being adjustable by winches. On a load suspension point 25, a load suspension device is arranged on the cable 20, e.g. a manipulator or spreader, by means of which the load 10 can be suspended. In the embodiment, the load suspension device additionally includes a rotator means, by means of which the load 10 can be rotated on the load suspension device. In a further embodiment of the invention, the crane furthermore includes at least one first and one second strand of cables for lifting the load, with all cable strands extending from the boom tip to the load suspension device.

As shown in particular in the top view, the load can be moved in tangential direction by slewing the tower 3 and in radial direction by luffing up the boom 1. In vertical direction, the load 10 is moved by luffing up the boom 1 and by changing the length of the cable 20. In addition, the load 10 can be rotated by the rotator unit on the load suspension device.

A first embodiment of the mobile crane shown in FIG. 0*a* now is equipped with the crane control of the invention, which includes a sensor unit for determining the cable angle relative to the direction of gravitational force. In the embodiment, the sensor unit includes two sensors, by means of which the radial and tangential cable angles can each be determined relative to the direction of gravitational force. By means of this sensor unit, the alignment of the crane when lifting the load is considerably simplified, as the cable can easily be aligned perpendicularly above the load 10 by means of this sensor unit.

However, the crane control in accordance with the invention can not only be used in the illustrated embodiment, i.e. in a mobile harbour crane, but advantageously also in other cranes, such as e.g. ship cranes, off-shore cranes, truck cranes and crawler cranes.

The inventive sensor unit for determining the cable angle relative to the direction of gravitational force is particularly advantageous especially in boom cranes, since known systems, as they are used for instance in cranes with a trolley merely movable in horizontal direction, and which employ measurement camera systems, cannot be used with the same. In boom cranes, such measurement camera systems would be moved together with the boom and hence merely determine the angle of the cable with respect to the boom, but not with respect to the plumb line. In addition, such systems would always have to be arranged directly behind the cable checkpoint on the boom head, which is, however, hardly possible with a movable cable guided over a deflection pulley on the boom head.

Figure 0B:
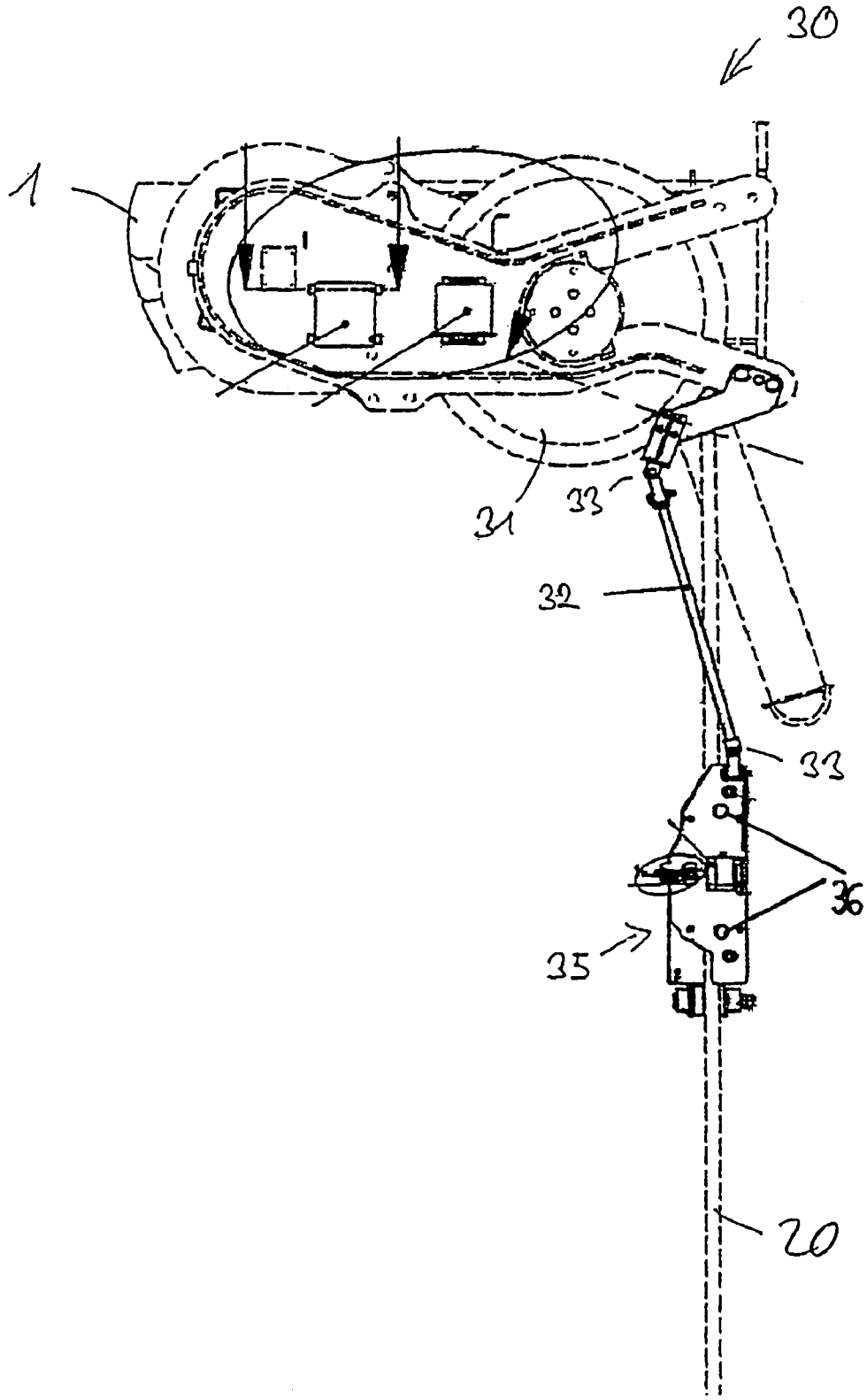
FIG. 0*b*: shows an embodiment of an inventive cable follower of the inventive crane control.

The inventive sensor unit for determining the cable angle relative to the direction of gravitational force can, however, easily be arranged in a cable follower 35, as it is shown in FIG. 0*b*, and directly determines the cable angle relative to the direction of gravitational force in tangential and radial direction. A determination of the cable angle relative to the boom 1 can completely be omitted. However, if this angle of the cable relative to the boom 1 is of interest, another sensor unit could also be arranged on the boom 1 for determining the angle of the boom relative to the direction of gravitational force, in order to determine the angle between cable and boom via the difference of the respective angles of cable and boom to the direction of gravitational force.

The cable follower 35 shown in FIG. 0*b*, on which the sensor unit for determining the cable angle relative to the direction of gravitational force is arranged, is mounted on the boom head 30 of the boom 1 by cardan joints 32 and 33 below the main pulley 31. The cable follower 36 includes pulleys 36, by which the cable 20 is guided, so that the cable follower 35 follows the movements of the cable 20. The cardan joints 32 and 33 enable the cable follower to freely move about a horizontal and a vertical axis, but inhibit rotary movements. The alignment of the cable follower 35 and hence of the cable 20 relative to the direction of gravitational force can thus be determined via the sensor unit for determining the cable angle relative to the direction of gravitational force, which is arranged on the cable follower 35.

Furthermore advantageously, in this embodiment a gyroscope unit also is arranged on the cable follower 35, by means of which the cable angular velocity can be measured in radial and tangential direction, for which purpose at least two correspondingly aligned gyroscopes are used. The data of the gyroscopes advantageously are available for load oscillation damping, which prevents the pendular movement of the load during a movement of the crane.

If several cable strands are provided, by means of which the load suspension element is suspended on the boom, corresponding cable followers 35 advantageously are associated to at least two of these cable strands, in order to be able to also consider the cable field twisting, which results from a rotation of the load suspension element out of the plane of the cable field. Advantageously, the cable followers are arranged on the respective cable strands arranged on the outside, so that a cable field twisting maximally is expressed in the difference of the cable angles. The actual cable angle relative to the direction of gravitational force, which corresponds to a deflection of the load from the plumb line, can be determined by averaging the values from the sensor units on the respective cable followers, the twisting of the load from the difference of the values.

The cardan joint 32, 33 merely serves the mechanical connection of the cable follower 35 with the boom head 30; the measurement of the cable angle is only effected via the sensor units integrated in the cable followers 35, but not by determining the angle between the cable follower 35 and the boom 30. In this way, merely the relative alignment of the cable with respect to the boom 30 could be determined, but not the cable angle of the cable 20 relative to the direction of gravitational force.

In a further embodiment of the invention, in which at least one first and one second strand of cables are provided, by means of which the load suspension element is suspended on the boom, corresponding cable followers 35 likewise are associated thereto, which are equipped with gyroscope units and thus determine the cable velocity of these cable strands. The determination of the cable velocities of the first and second strands of cables provides for considering the cable field twisting in the load oscillation damping for damping spherical pendular oscillations of the load and for correcting measurement errors. In this embodiment, the sensor units for determining the cable angle relative to the direction of gravitational force can also be omitted, and the cable followers 35 can merely be equipped with gyroscope units.

As an alternative to the arrangement of the inventive sensor unit for determining the cable angle relative to the direction of gravitational force on a cable follower 35, the same could also be arranged for instance on the load suspension means, but in particular with several strands of cables, the cable followers provide an improved possibility for determining the twisting of the load.

Since the load oscillation dampings, which are shown in DE 100 64 182, DE 103 24 692, DE 100 29 579 and DE 10 2006 033 277, and with which the crane control of the embodiment of the invention advantageously is also provided, proceed from a load freely hanging on a cable and are based on gyroscope data, which cannot be used for determining absolute cable angles, these load oscillation systems can merely prevent a pendular movement of the load, which initially is hanging on the cable freely and without moving, during a movement of the crane.

In order to perpendicularly align the cable before or while lifting the load, so that the load can be lifted without swinging out, the crane control of the invention now is provided with the inventive sensor unit for determining a cable angle relative to the direction of gravitational force.

Figure 1A:
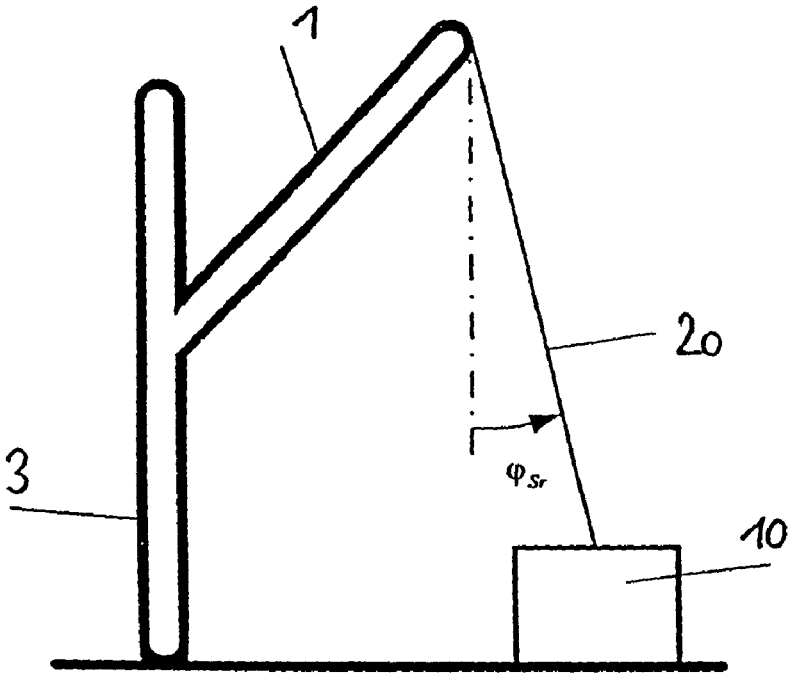
FIGS. 1*a*, 1*b*: show the oscillation of the load, when the cable was not aligned perpendicularly before lifting the load.
Figure 1B:
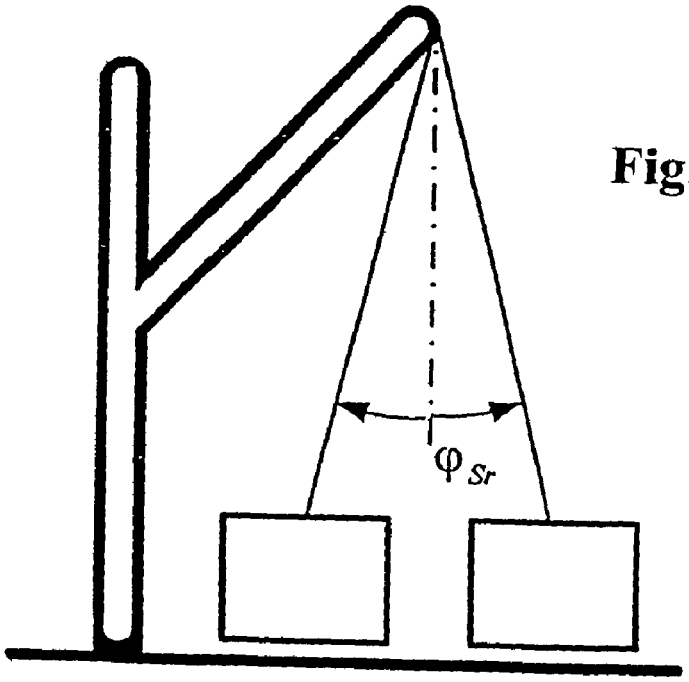

FIG. 1*a* shows the fundamental problem with a non-perpendicular alignment of the cable 20. The cable 20, which already is connected with the still supported load 10 via a load suspension means, includes an angle $\phi_{Sr}$ relative to the direction of gravitational force indicated in phantom due to the wrong alignment of the boom 1. When the load 10 is now lifted from this position by reducing the length of the cable 20, the oscillation about the plumb line as shown in FIG. 1*b* is produced, when the load 10 gets free. Such oscillation produced when lifting the load 10 is particularly dangerous, as it occurs near the ground and objects in the surroundings of the load 10 can easily be damaged.

Before getting free, the load 10 can also slip or be twisted in an uncontrolled way by getting free non-uniformly. In FIGS. 1*a* and 1*b*, the deflection $\phi_{Sr}$ in radial direction is illustrated by way of example. The same problem likewise arises for a deflection of the cable 20 in tangential direction, which is caused by a wrong position of the tower 3.

To avoid such deflection of the cable 20 from the plumb line at the beginning of hoisting, the embodiment of the crane control of the invention therefore includes a display, which indicates the cable angle $\phi$ of the cable 20 relative to the direction of gravitational force, i.e. to the plumb line. For instance, the display on the one hand can optically and/or acoustically indicate a perpendicular cable position and also indicate the direction in which the cable 20 is deflected from the plumb line.

Such display thus can include e.g. display elements for a deflection to the front and to the rear and display elements for a deflection to the left or right, which indicate a deflection in radial or tangential direction.

Alternatively, the horizontal deviation of the load from a zero position, which corresponds to a perpendicular alignment of the cable, can also be indicated. In particular, a graphic display of the zero position and of the deviation of the load is conceivable, so that the absolute deflection of the load is directly indicated to the crane operator.

By means of such display, the crane operator can easily align the crane at the beginning of hoisting, so that the cable 20 is perpendicularly arranged above the load 10. The correct perpendicular cable position then can be indicated e.g. acoustically by a signal tone.

In an alternative embodiment, possibly in addition to the display, a function for automatically aligning the cable in perpendicular direction is provided. By actuating this function, the crane is automatically aligned upon fastening the load suspension means to the load such that the cable is perpendicular. To avoid an uncontrolled movement of the crane in the case of a malfunction of the inventive sensor unit, this automatic function advantageously is connected e.g. with a cable force measuring means, which switches off the automatic operation in the case of errors.

When using a plurality of cable strands between boom head and load suspension means, the cable field twisting can also be determined via a plurality of sensor units. This cable field twisting corresponds to the twisting of the load suspension means, e.g. a spreader, and would lead to a rotation of the load when lifting the load. To prevent this, the twisting of the cable field also is indicated advantageously, possibly beside the cable angle relative to the direction of gravitational force or the horizontal deviation of the load. If the load suspension means includes a rotor means, the cable field twisting thereby can be set to 0 before hoisting, in order to prevent a rotation of the load 10 when lifting the same. For this purpose, a function for automatically aligning the rotor means can also be provided advantageously in a further embodiment.

Furthermore, the embodiment of the crane control of the invention includes a warning means beside the display, which warns the crane operator by an optical and/or acoustic signal when the admissible range of values for a deviation resulting from the measured cable angle, in particular for the cable angle relative to the gravitational force, is exceeded. As a result, it is possible for the crane operator to prevent too much deflection of the cable and thus protect the crane e.g. against overloading. An excessive pendular movement of the load when being lifted can also be prevented in this way.

In an alternative embodiment, possibly in addition to the warning means, an automatic protection means, e.g. in the form of an overload protection, can be provided, which automatically intervenes in the control of the crane when the admissible range of values is exceeded. In particular, the automatic overload protection stops the movement of the crane, in order to prevent an overload. The overload protection can be integrated in the load moment limitation of the crane, which thus protects the crane against being loaded by too large a cable angle.

In another embodiment it is furthermore provided that lifting the load 10 is not possible as long as the cable angle or the cable field twisting is not in the admissible range. In this way, an unintentional pendular movement of the load 10 when being lifted is effectively prevented.

In FIGS. 2 and 3 now, two situations are shown, in which the cable 20 initially is aligned perpendicularly, but is moved away from the plumb line when the load 10 is lifted.

Figure 2A:
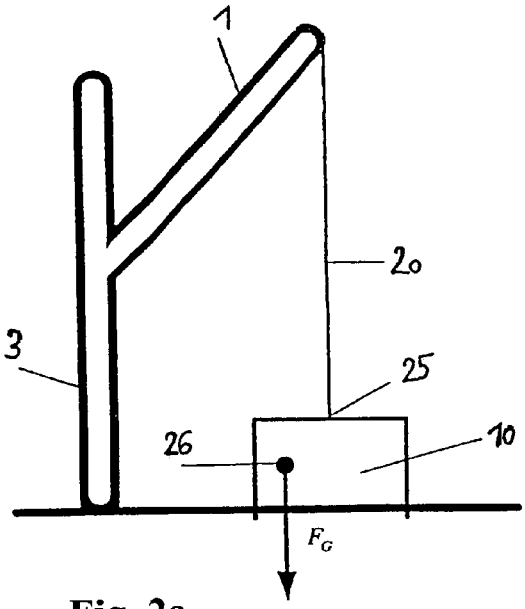
FIGS. 2*a*-2*c*: show an embodiment of the method of the invention, in which an imbalance of the load is compensated.
Figure 2B:
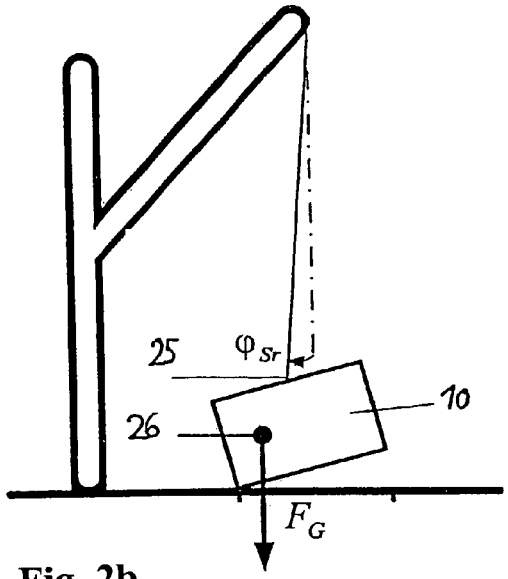
Figure 2C:
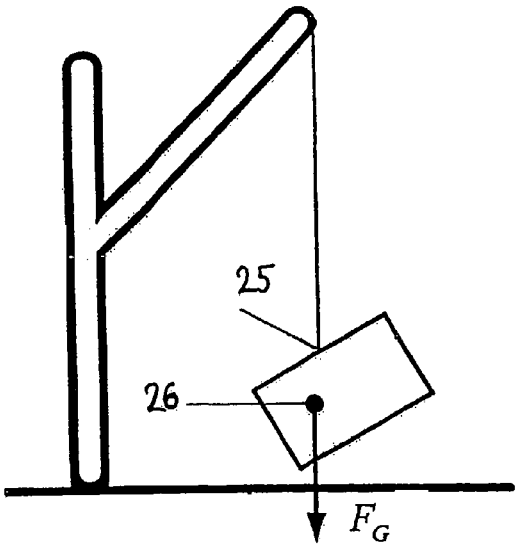

In FIGS. 2*a* to 2*c* this is effected in that the center of gravity 26 of the load 10 is not below the load suspension point 25 at the beginning of the hoisting operation. When the load 10 now is lifted, as shown in FIG. 2*b*, the same is tilted, until the center of gravity 26 of the load is disposed below the load suspension point 25. Due to this canting of the load 10, however, the load suspension point 25, to which the cable 20 is attached e.g. to the load suspension means, is moved in horizontal direction, in the case shown here radially to the inside. As a result, the cable angle relative to the plumb line is changed, which would lead to an undesired oscillation of the load when the load 10 completely gets free.

In one embodiment of the method of the invention, the deviation of the cable angle from the plumb line therefore is determined while lifting the load 10. In the most simple embodiment, the crane operator checks the cable angle or the horizontal deviation on the display and readjusts the crane during the hoisting operation, in order to again compensate the deviation of the cable angle from the plumb line due to the imbalance of the load. In an improved embodiment, the imbalance of the load is determined on the basis of the deviation of the cable angle from the plumb line and indicated, so that the crane operator can react in a better way.

In the position shown in FIG. 2*c*, the crane now has been moved such that the inclination due to the imbalance of the load, in which the center of gravity 26 is disposed below the load suspension point 25, was compensated. When the load 10 gets free completely, an unintentional oscillation of the load due to the imbalance of the load thereby is avoided.

In a non-illustrated embodiment of the invention, the load suspension means includes a device for the in particular linear movement of the load 10 relative to the load suspension point 25, by means of which the center of gravity 26 of the load can be arranged below the load suspension point 25 without tilting the load 10. For this purpose, the load suspension means, e.g. a spreader, includes e.g. a longitudinal displacement of the load suspension point 25 relative to the load, e.g. a container.

When a deviation of the cable angle from the plumb line now is detected when lifting the load, the crane operator can shift the load suspension point relative to the load, until the cable again is aligned perpendicularly. Likewise, the imbalance of the load can be determined and indicated by means of the deviation of the cable angle from the plumb line, so that the crane operator can perform the actuation of the longitudinal adjustment of the spreader by means of this indication. An automatic adjustment of the spreader is also conceivable.

Such adjustment of the spreader by means of the deviation of the cable angle from the plumb line is particularly advantageous, as tilting of the container in particular when being loaded in a ship can lead to jamming of the containers, so that loading can be impeded considerably.

Figure 3A:
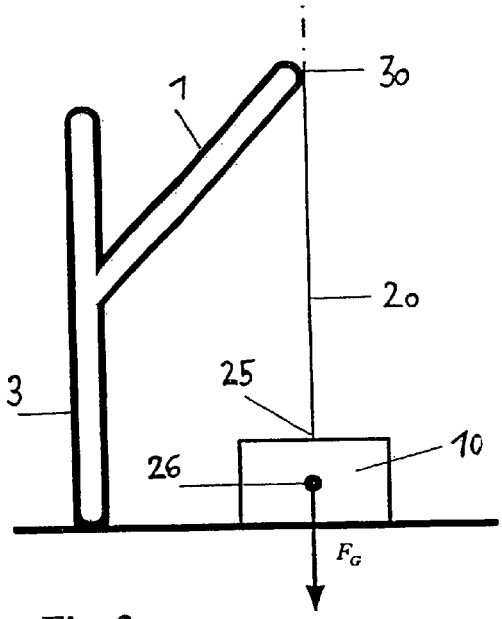
FIGS. 3*a*-3*c*: show an embodiment of a method of the invention, in which the yielding of the crane structure under a load is compensated.
Figure 3B:
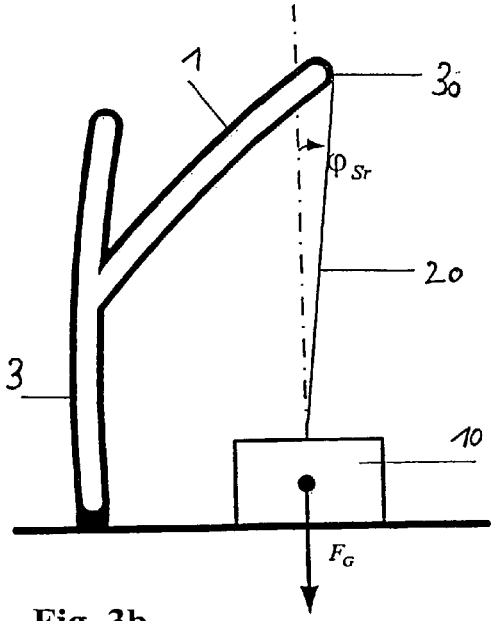
Figure 3C:
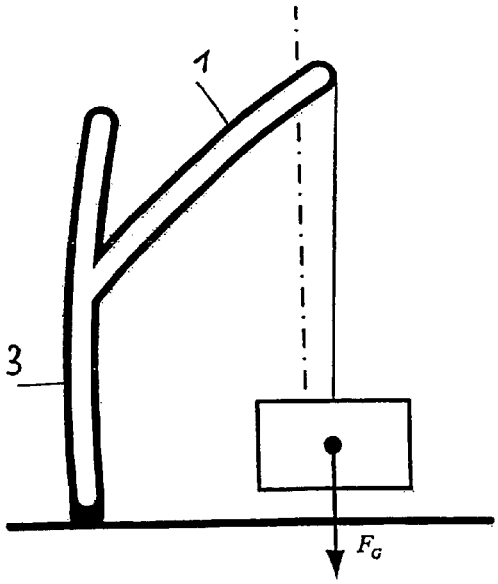

FIGS. 3*a* to 3*c* now illustrate a further effect which can cause a deviation of the cable angle from the plumb line when lifting the load. In FIG. 3*a*, the cable 20 still is aligned perpendicularly before the beginning of the hoisting operation. Since the center of gravity 26 of the load is located below the load suspension point 25, i.e. the load has no imbalance, the load suspension point 25 is not shifted in this case when lifting the load 10. As shown in FIG. 3*b*, however, the crane structure yields due to the load applied when lifting the load, with tower 3 and boom 1 being slightly bent forward in this case. As a result, the boom tip 30, over which runs the cable 20, is moved relative to the load suspension point 25, so that a deviation of the cable angle from the plumb line results from the yielding of the crane structure.

In a first embodiment of the method in accordance with the invention, this deviation is compensated by the crane operator by means of the indication of the cable angle when lifting the load. It is also possible to determine the deviation of the cable angle from the plumb line due to the crane structure yielding under the load, which can then be indicated to facilitate the work of the crane operator. In a further embodiment, an automatic tracking of the crane is possible for the perpendicular alignment on the basis of the data of the sensor unit for determining the cable angle relative to the direction of gravitational force. When the cable angle again is aligned perpendicularly, the load can be lifted without oscillations, as shown in FIG. 3*c*.

FIG. 4*a* shows another embodiment of the crane of the invention. This is an off-shore crane, which is arranged on an off-shore platform 50 and is used e.g. for loading a load 10 from a ship 60 onto the platform 50. Since the ship 60 can move relative to the platform 50, the cable angle of the cable 20 relative to the plumb line can also be changed without a movement of the crane due to a movement of the ship.

To account for this situation, an overload function is provided in one embodiment of the crane control of the invention, which possibly can be used beside the above-described warning and safety functions. To prevent e.g. a destruction of the crane when the cable 20 gets entangled with the ship 60 and the movement of the ship 60 threatens to overload the crane, countermeasures are taken when the cable angle exceeds a maximum admissible range. In particular, the movement of the crane can partly be enabled, in that for instance the cable 20 is released or the stewing movement of the tower 3. This release is effected in a controlled way with a certain counterforce, in order to avoid sudden jerks.

On the basis of the cable angle relative to the direction of gravitational force, an easily performed overload protection can thus be realized, which only by means of a cable force sensor is difficult to realize. By means of such overload protection, which effects a partial release of the crane movement, an uncontrolled dragging of the load 10 over the ship 60 can also be prevented.

The admissible range 70 for the cable angle in X and Y direction is shown in hatched lines e.g. in FIG. 4*b*. If the cable angle exceeds this admissible range 70, either the inventive warning function or one of the inventive overload functions will be initiated.

FIG. 4*b* shows a display element for indicating a deviation from a perpendicular position of the cable, with an admissible range 70 for the cable angle and for the horizontal deviation in X and Y direction, i.e. in radial and tangential direction. The indication of the cable angle here is effected graphically, e.g. in that the cable angle is represented as a dot in the diagram shown in FIG. 4*b*. Instead of the cable angle, the horizontal deviation of the load from the zero position located in the middle can also be illustrated, i.e. the distance of the load from the position in which it would be with the same crane position, but perpendicular cable. The crane operator thus can directly see the absolute deflection of the load and estimate more easily how far the crane must be moved for a correct alignment of the cable.

Due to the inventive determination of the cable angle relative to the plumb line by a sensor unit for determining a cable angle relative to the direction of gravitational force and the corresponding crane controls and crane control methods in accordance with the invention, a considerably increased safety when hoisting loads is possible beside an easier operation and alignment of the crane.

In a further embodiment of the present invention, the crane includes at least one first and one second strand of cables, which connect the load suspension means with the boom tip. In particular, this provides an improved damping of the spherical oscillations of the load by the crane control in accordance with the invention.

Control and automation concepts for cranes, which prevent the pendular movement of the load on the cable during a crane movement, are dependent on the accurate measurement of the cable angles. In particular in boom cranes it is advantageous to not directly determine the cable angles for instance via image-processing methods, but to measure the angular velocities by means of gyroscopes.

However, since the gyroscope signals include an offset and also detect disturbing influences, such as cable harmonics, observer circuits are used for integrating the velocities to obtain the cable angles.

To detect the angular velocities of the oscillating load, the gyroscopes are attached to the cable below the boom tip by means of a mechanical construction. For detecting the spherical oscillation of the load two gyroscopes are necessary, which are arranged in tangential and radial direction.

Figure 5:
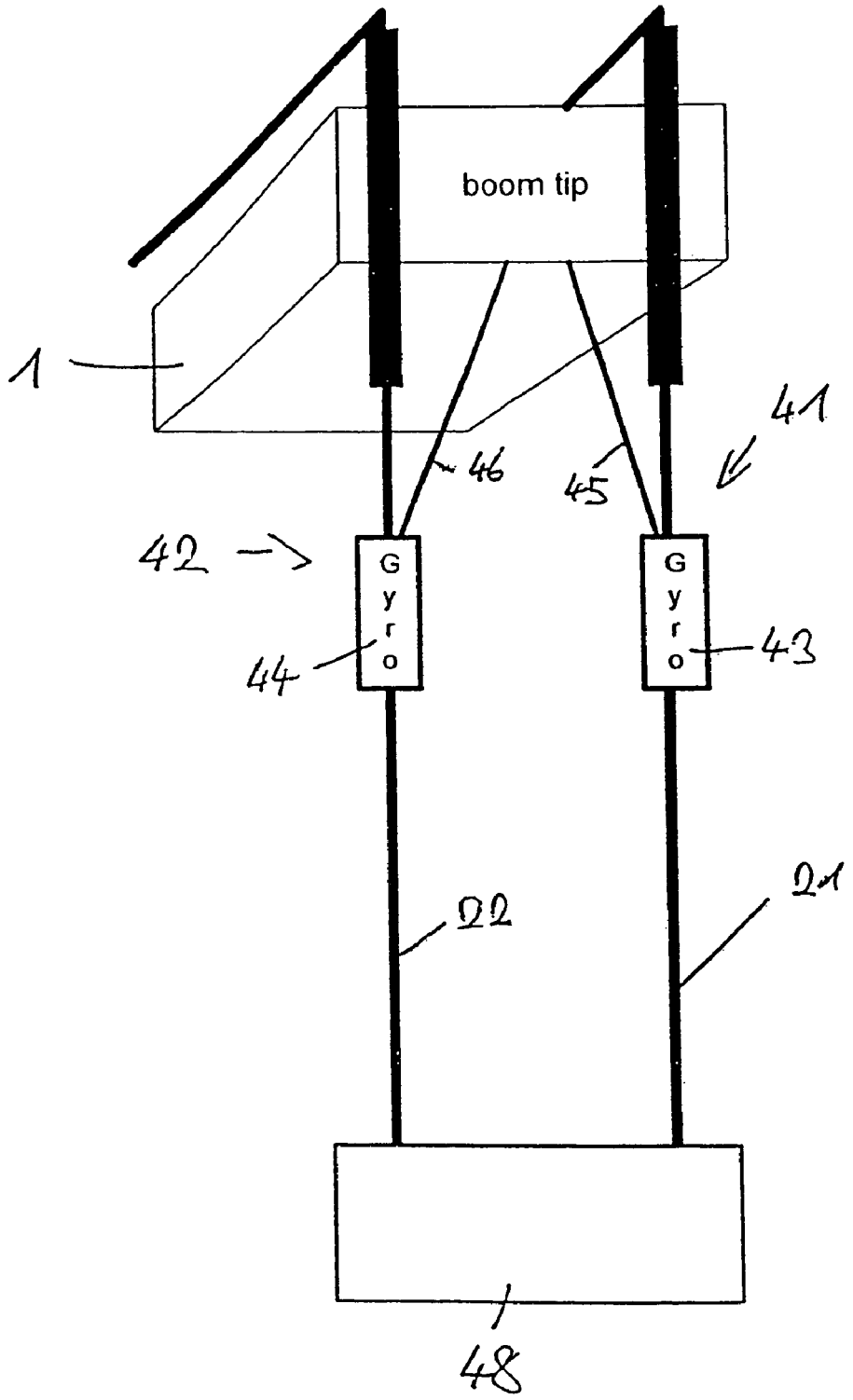
FIG. 5: shows another embodiment of the present invention, in which two strands of cables are provided, each with associated sensor units.
Figure 6:
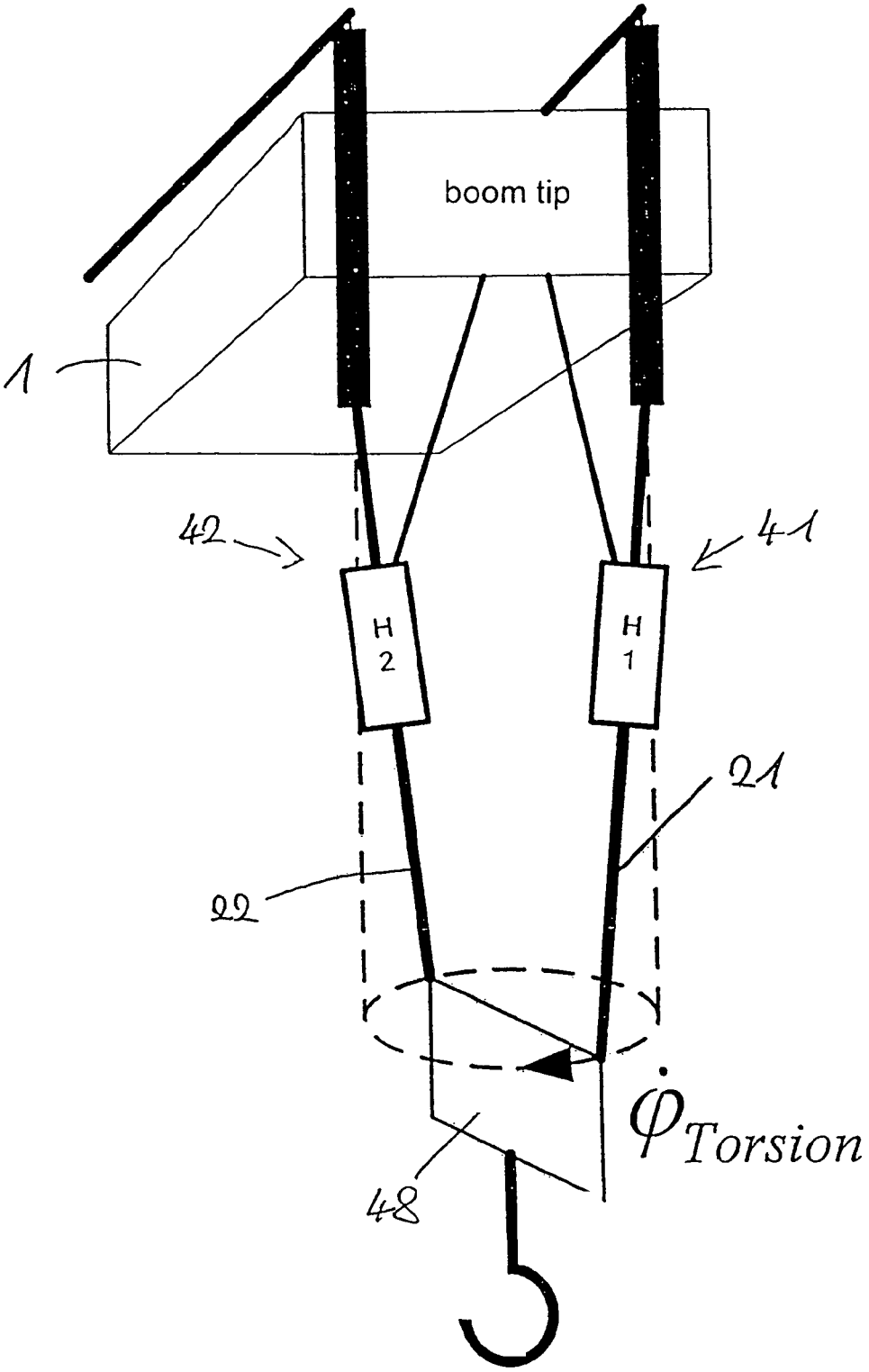
FIG. 6: shows a torsional oscillation of the cable field including first and second strands of cables.
Figure 7:
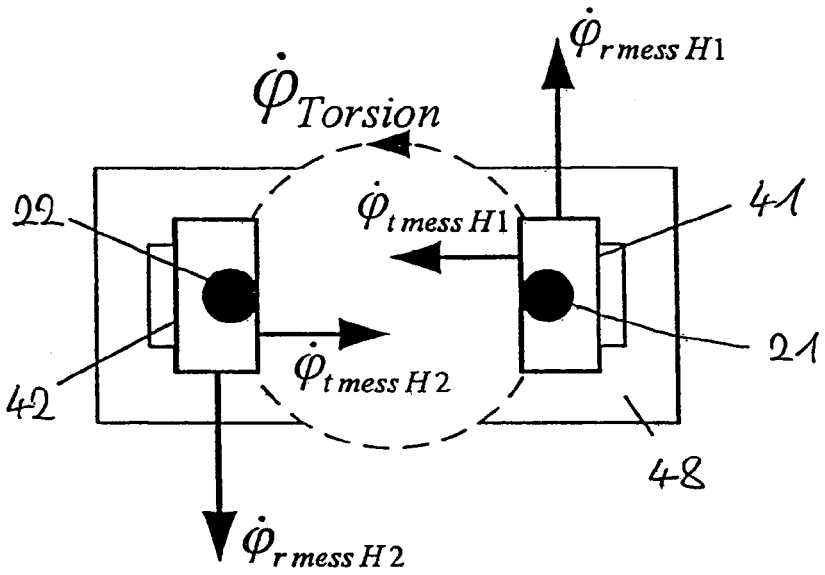
FIG. 7: shows a schematic diagram of the cable velocities measured during a torsional oscillation of the cable field.

As shown in FIG. 5, it is now proposed for an improved load oscillation damping to associate a cable follower as shown in FIG. 0*b* both to the first and to the second strand of cables. Instead of the sensor unit for determining a cable angle relative to the direction of gravitational force, the cable followers are, however, equipped with gyroscope units, which are better suited for load oscillation damping. By means of the same, the angular velocity of the oscillating crane load is detected.

FIG. 0*b* shows a first cable follower 35, on which the first sensor unit associated to the first strand of cables is arranged in the embodiment shown here. The first cable follower is mounted on the boom head 30 of the boom 1 by cardan joints 32 and 33 below a first pulley 31, over which the first cable strand 20 is guided. The cable follower 35 includes pulleys 35, by which the first cable strand 20 is guided, so that the cable follower 35 follows the movements of the cable strand 20. The cardan joints 32 and 33 allow the cable follower to freely move about a horizontal and a vertical axis, but inhibit rotary movements. The radial and tangential angular velocity of the first cable follower 35 and hence of the first cable strand 20 thus can be determined via the first sensor unit arranged on the cable follower 35, which is configured as a gyroscope unit. A second cable follower with a second sensor unit, which is associated to a second strand of cables, is constructed analogous to the first cable follower and connected with the boom tip. The second cable follower correspondingly measures the angular velocity of the second strand of cables.

The gyroscope signals (angular velocities in tangential and radial direction) of both cable followers are prepared and processed with identical algorithms. First of all, disturbing influences, which are caused by wrong assembly, are compensated by the corresponding software (see equation 0.1). If the planes of sensitivity of the gyroscope sensors are not exactly located in tangential and radial direction, but tilted due to wrong assembly, the sensors proportionally measure also the slewing speed of the crane.

$$\dot{\phi}_{t/r\ komp}=\dot{\phi}_{t/r\ mess}-\sin(\phi_{einbau})\dot{\phi}_D \tag{0.1}$$

The mounting or assembly angle for each gyroscope sensor on both cable followers each is $\phi_{einbau}$, $\dot{\phi}_D$ is the slewing speed of the crane, $\dot{\phi}_{t/r\ mess}$ is the tangential or radial angular velocity, and $\dot{\phi}_{t/r\ komp}$ is the resulting compensated gyroscope signal.

Furthermore, the compensated measurement signals are integrated by means of an observer circuit to obtain the cable angles free from offset. After such processing, the cable angles now are available for both cable followers in tangential and radial direction.

The expansion of the measurement concept by the second cable follower leads to two essential advantages as compared to the variant with only one cable follower or the variant with the gyroscope sensors in the hook.

The first advantage is the redundancy of the measurement of load oscillation. In the case of the failure of a sensor on one of the two cable followers, the angular velocity still is detected by the sensor of the other holder. The basic function of the crane control (oscillation damping and sequence of trajectories) can thus be ensured. By forming the difference of the angle signals of both cable followers in the respective directions, a sensor error still can be detected when a threshold value is exceeded. When a sensor error occurs, the crane thus can immediately be brought into a safe condition.

The second advantage is the possibility for compensating the torsional oscillation of the load. As shown by equation 0.2, the mean value of the angle signals of the two cable followers is calculated in the corresponding direction.

$$\varphi_t = \frac{\varphi_{t\ beob\ H1} + \varphi_{t\ beob\ H2}}{2} \tag{0.2}$$

$$\varphi_r = \frac{\varphi_{r\ beob\ H1} + \varphi_{r\ beob\ H2}}{2}$$

The cable angle in tangential direction $\phi_t$ thus is calculated from the mean value of the observed angle signals of the holder 41 $\phi_{t\ beob\ H1}$ and of the holder 42 $\phi_{t\ beob\ H2}$. The same is true for the cable angle in radial direction symbolized by the index r. In the case of a torsion of the load with the angular velocity $\dot{\phi}_{Torsion}$, the gyroscopes on the cable followers 41 and 42 exactly measure an opposite parasitic oscillation both in tangential and in radial direction. By forming an average, the influence of the torsional oscillation thus can be eliminated. The inventive control of load oscillation damping, in which the data generated by the two gyroscope units are included, will now be illustrated in detail below.

In the case discussed here, the dynamics of the boom movement is characterized by some predominant non-linear effects. The use of a linear control unit would therefore lead to great errors in the tracking of trajectories and to an insufficient damping of load oscillation. To overcome these problems, the present invention utilizes a non-linear control procedure, which is based on the inversion of a simplified non-linear model. This control procedure for the luffing movement of a boom crane allows a non-slewing load movement in radial direction. By using an additional stabilizing control loop, the resulting crane control in accordance with the invention shows a high accuracy of the tracking of trajectories and a good damping of load oscillation. Measurement results are submitted to validate the good performance of the non-linear control unit for the tracking of trajectories.

Boom cranes, such as the LIEBHERR mobile harbour crane LHM (see FIG. 1), are used for efficiently handling loading processes in harbours. Boom cranes of this type are characterized by a load capacity of up to 140 tons, a maximum outreach of 48 meters, and a cable length of up to 80 meters. During the transfer process, a spherical load oscillation is induced. Such load oscillation must be avoided for safety and performance reasons.

As shown in FIG. 1, such mobile harbour crane consists of a mobile platform 6, on which a tower 3 is mounted. The tower 3 can be slewed about a vertical axis, with its position being described by the angle $\phi_D$. On the tower 3, a boom 1 is pivotally mounted, which can be luffed by the actuator 4, with its position being described by the angle $\phi_A$. The load 10 is suspended from the head of the boom 1 on a cable of the length $l_S$ and can oscillate under the angle $\phi_{Sr}$.

In general, cranes are sub-actuated systems which show an oscillating behavior. Therefore, many regulated and unregulated control solutions were proposed in the literature. However, these approaches are based on the linearized dynamic model of the crane. Most of these contributions do not consider the actuator dynamics and kinematics. In a boom crane, which is driven by hydraulic actuators, the dynamics and kinematics of the hydraulic actuators are not negligeable. In particular in the boom actuator (hydraulic cylinder), the kinematics must be taken into account.

The following embodiment of the present invention utilizes a flatness-based control approach for the radial direction of a boom crane. The approach is based on a simplified non-linear model of the crane. Thus, the law of the linearizing control can be formulated. Furthermore, it is shown that the zero dynamics of the non-simplified non-linear control loop ensures a sufficient damping property.

1. Non-Linear Model of the Crane

In consideration of the control objects of preventing load oscillation and of tracking a reference trajectory in radial direction, the non-linear dynamic model must be derived for the luffing movement. The first part of the model is obtained by neglecting mass and elasticity of the cable assuming that load is a point mass neglecting the centripetal and Coriolis terms Using the Newton/Euler method and considering the specified assumptions leads to the following differential equation of the movement for load oscillation in radial direction:

$$\ddot{\varphi}_{Sr} + \frac{g}{l_S}\sin(\varphi_{Sr}) = \frac{\cos(\varphi_{Sr})}{l_S}\ddot{r}_A \tag{1}$$

Figure 8:
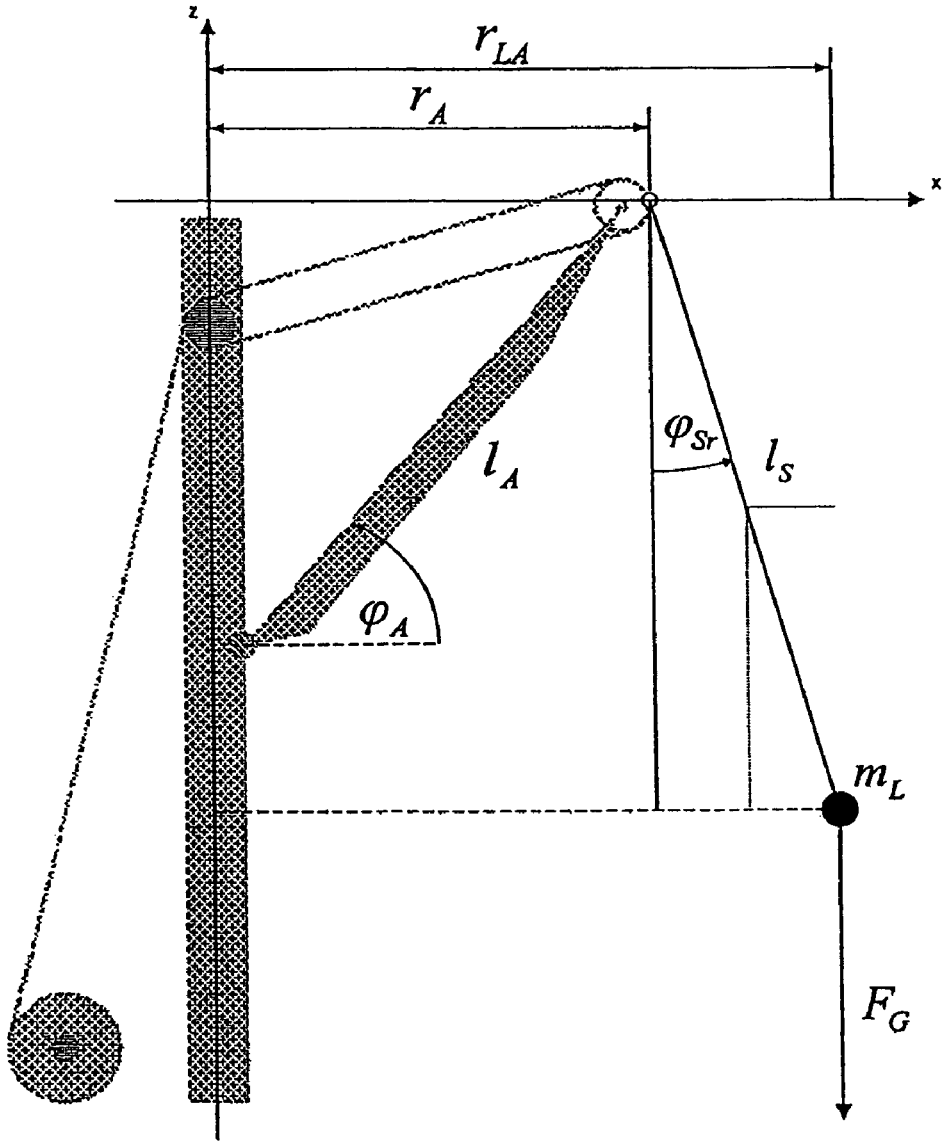
FIG. 8: shows a schematic representation of the crane in accordance with the invention.

FIG. 8 is a schematic representation of the luffing movement, wherein $\phi_{Sr}$ is the radial cable angle, $\ddot{\phi}_{Sr}$ the radial angular acceleration, $l_S$ the cable length, $\ddot{r}_A$ the acceleration of the boom end, and g the gravitational constant.

The second part of the dynamic model describes the kinematics and dynamics of the actuator for the radial direction. Assuming that the hydraulic cylinder exhibits a first-order behavior, the differential equation of the movement is obtained as follows:

$$\ddot{z}_{zyl} = -\frac{1}{T_W}\dot{z}_{zyl} + \frac{K_{VW}}{T_W A_{zyl}}u_l \tag{2}$$

Wherein $\ddot{z}_{zyl}$ and $\dot{z}_{zyl}$ are the cylinder acceleration and the velocity, $T_W$ is the time constant, $A_{zyl}$ is the cross-sectional area of the cylinder, $u_W$ is the input voltage of the servo valve, and $K_{VW}$ is the proportional constant of flow rate to $u_W$.

Figure 9:
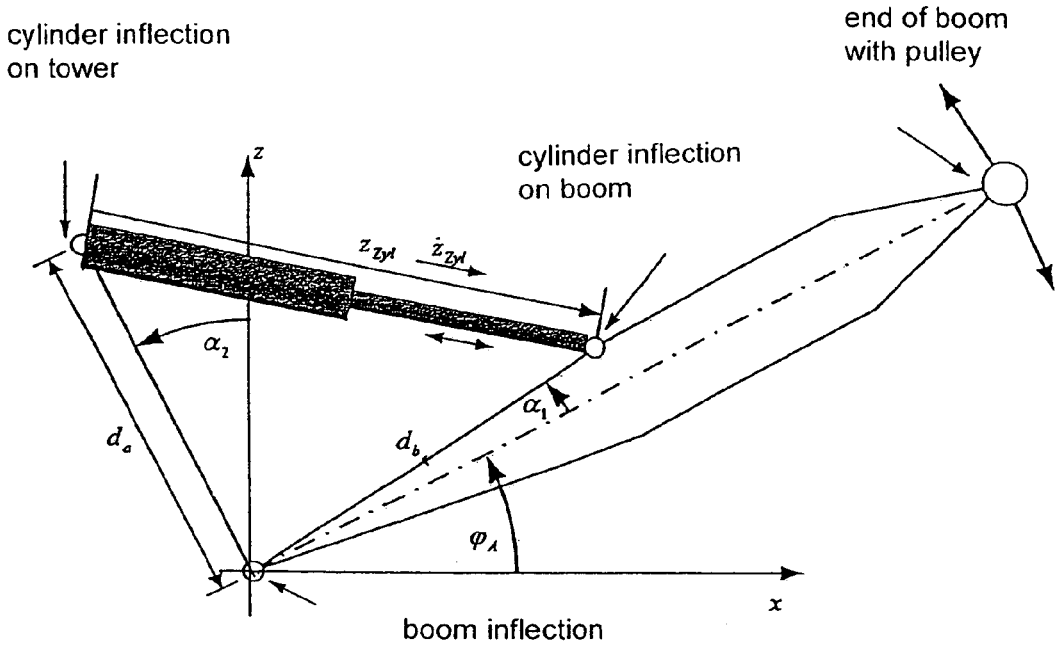
FIG. 9: shows a schematic representation of the luffing gear of the crane in accordance with the invention.

FIG. 9 shows a schematic representation of the kinematics of the actuator with the geometric constants $d_a$, $d_b$, $\alpha_1$, $\alpha_2$. To obtain a conversion of cylinder coordinates ($z_{zyl}$) to outreach coordinates ($r_A$), the kinematic equation $$r_A(z_{zyl}) = l_A\cos\left(\alpha_{A0} - \arccos\left(\frac{d_a^2 + d_b^2 - z_{zyl}^2}{2d_a d_b}\right)\right) \tag{3}$$

is differentiated.

$$\dot{r}_A = -l_A\sin(\phi_A)K_{Wz1}(\phi_A)\dot{z}_{zyl} \tag{4}$$

$$\ddot{r}_A = -l_A\sin(\phi_A)K_{Wz1}(\phi_A)\ddot{z}_{zyl} - K_{Wz3}(\phi_A)\dot{z}_{zyl}^2$$

$K_{Wz1}$ and $K_{Wz3}$ describe the dependence on the geometric constants $d_a$, $d_b$, $\alpha_1$, $\alpha_2$ and the luffing angle $\phi_A$ (see FIG. 9). $l_A$ is the length of the boom.

Formulating the first-order behavior of the actuator in terms of outreach coordinates by using the equations (4) leads to a non-linear differential equation.

$$\ddot{r}_A = -\underbrace{\frac{K_{Wz3}}{l_A^2\sin^2(\varphi_A)K_{Wz1}^2}}_{a}\dot{r}_A^2 = \underbrace{\frac{1}{T_W}}_{b}\dot{r}_A - \underbrace{\frac{K_{VW}l_A\sin(\varphi_A)K_{Wz1}}{T_W A_{zyl}}}_{m}u_l \tag{5}$$

For representation of the non-linear model in the form $$\dot{\underline{x}}_l = \underline{f}_l(\underline{x}_l) + \underline{g}_l(\underline{x}_l)\cdot u_l \tag{6}$$

$$y_l = h_l(\underline{x}_l)$$

the equations (1) and (6) are used. As a result, the status $\underline{x} = [r_A\ \dot{r}_A\ \phi_{Sr}\ \dot{\phi}_{Sr}]^T$ used as an input and the radial position of the load $y = r_{LA}$ provided as an output lead to:

$$\underline{f}_l(\underline{x}_l) = \begin{bmatrix} x_{l,2} \\ -ax_{l,2}^2 - bx_{l,2} \\ x_{l,4} \\ -\frac{g}{l_S}\sin(x_{l,3}) + \frac{\cos(x_{l,3})}{l_S}(ax_{l,2}^2 + bx_{l,2}) \end{bmatrix}; \tag{7, 8}$$

-continued $$\underline{g}_l(\underline{x}_l) = \begin{bmatrix} 0 \\ -m \\ 0 \\ \frac{\cos(x_{l,3})m}{l_S} \end{bmatrix}$$

$$h_l(\underline{x}_l) = x_{l,1} + l_S\sin(x_{l,3})$$

2. Non-Linear Control Approach

The following considerations were made on the assumption that the right side of the differential equation can be linearized for the load oscillation. Thus, inducing the radial load oscillation is decoupled from the radial cable angle $\phi_{Sr}$.

$$\ddot{\varphi}_{Sr} + \frac{g}{l_S}\sin(\varphi_{Sr}) = \frac{1}{l_S}\ddot{r}_A \tag{9}$$

To find a flat output for the simplified non-linear system, the relative degree must be determined.

2.1 Relative Degree

The relative degree is defined by the following conditions:

$$L_{\underline{g}_l}L_{\underline{f}_l}^i h_l(\underline{x}_l) = 0\ \forall i = 0, \ldots r-2 \tag{10}$$

$$L_{\underline{g}_l}L_{\underline{f}_l}^{r-1}h_l(\underline{x}_l) \neq 0\ \forall x \in R^n$$

The operator $L_{\underline{f}_l}$ represents the Lie derivative along the vector field $\underline{f}_l$ or $L_{\underline{g}_l}$ along the vector field $g_l$. With the real output $$y_l^* = h_l^*(\underline{x}_l) = x_{l,1} + l_s x_{l,3} \tag{11}$$

a relative degree of r=2 is obtained. Since the order of the simplified non-linear model is 4, $y_l$ is a non-flat output. But with a new output $$y^* = h^*(\underline{x}) = x_l + l_s x_3 \tag{12}$$

a relative degree of r=4 is obtained. Assuming that only small radial cable angles occur, the difference between the real output $y_l$ and the flat output $y_l^*$ can be neglected. This simplification is chosen, in order to minimize the calculation time for the generation of trajectories described in chapter 3.

2.2 Exact Linearization

Since the simplified representation of the system is differentially flat, an exact linearization can be performed. Therefore, a new input is defined as $v = \ddot{y}_l^*$, and the linearizing control signal $u_l$ is calculated by $$u_l = \frac{-L_{\underline{f}_l}^r h_l^*(x_l) + v_l}{L_{g_i}L_{\underline{f}_l}^{r-1}h_l^*(x_l)};\ v_l \ \ldots \text{ new input} \tag{13}$$

$$= \frac{g\sin(x_{l,3})x_{l,4}^2 - g\cos(x_{l,3})\left(-\frac{g}{l_S}\sin(x_{l,3}) + \frac{a}{l_S}x_{l,2}^2 + \frac{b}{l_S}x_{1,2}\right) + v_l}{\frac{gm}{l_S}\cos(x_{l,3})}$$

In order to stabilize the linearized system obtained, an error feedback is derived between the reference trajectory and the derivatives of the output y*.

$$u_l = \frac{-L_{\underline{f}_l}^r h_l^*(x_l) + v_l - \sum_{i=0}^{r-1} k_{l,i}\left[L_{\underline{f}_l}^i h_l^*(x_l) - y_{l,ref}^{*(i)}\right]}{L_{\underline{g}_l} L_{\underline{f}_l}^{r-1} h_l^*(x_l)} \tag{14}$$

Figure 10:
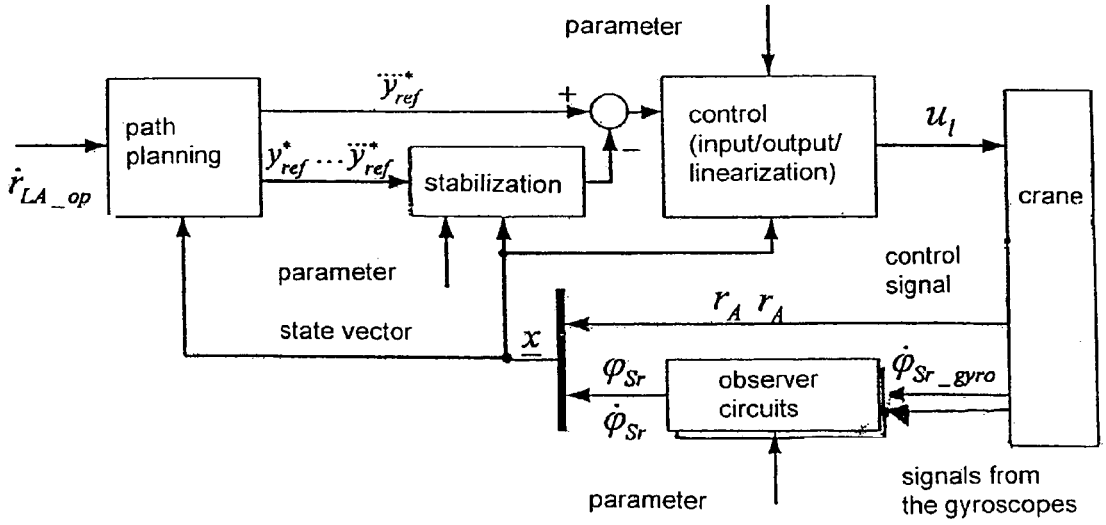
FIG. 10: shows a schematic representation of the crane control in accordance with the invention.

The feedback amplifications $k_{l,i}$ are obtained by the pole placement technique. FIG. 10 shows the resulting structure of the linearized and stabilized system.

The tracking control unit is based on the simplified load oscillation ODE (8) and not on the load oscillation ODE (1). Furthermore, the fictitious output $y_l^*$ is used for the design of the control unit. The resulting internal dynamics is shown in DE 10 2006 048 988, which is not yet published and whose contents form part of the present application.

3. Path Planning/Trajectory Generation

A. Formulation of the Optimal Control Problem

The problem of trajectory generation is formulated as a restricted optimal control problem of the open chain for the linearized system with status feedback. Due to the relevant calculation time for the solution of the optimal control problem, the model-predictive trajectory generation is performed with a non-negligeable scan time. By means of the numerical solution method itself, a discretization of the time axis is introduced. For the sake of simplicity, however, the optimal control problem was continually represented in continuous time.

The model equations are given by:

$$\dot{x}_{lin} = A_{lin}x_{lin} + b_{lin}u_{lin},\ x_{lin}(t_0) = x_{lin,0} \tag{15}$$

$$y_{lin} = C_{lin}x_{lin}$$

The state variables $x_{lin}$ are the states of the integrator chain which is obtained from the linearized system, consisting of flatness-based controller (equation (14)) and non-linear system (equation (6)), and the states of the integrator chain for the reference trajectory. Additional states are introduced, in order to obtain a smooth input v. The initial state $x_{lin,0}$ is derived from the states of these integrators, the current system output and its derivatives. The outputs $y_{lin}$ of the linear system (equation (15)) are variables which correspond to the flat output y* (equation (12)) and its first and second derivatives. These variables are the position, velocity and acceleration of the load in radial direction.

The power functional $$J_c = \frac{1}{2}\int_{t_0}^{t_f} ((y_{lin} - w)^T Q(y_{lin} - w) + r\dot{u}_{lin}^2)\,dt \tag{16}$$

on the one hand considers the square deviation of the predicted outputs $y_{lin}$ from the reference prediction w(t) thereof and on the other hand the square change of the input variable $u_{lin}$. The optimization horizon $t_f$-$t_0$, the symmetrical, positive semi-definite weighting matrix Q and the weighting coefficient r>0 are essential adjustment parameters for the model-predictive trajectory generation.

The optimization horizon $t_f$-$t_0$ should capture the essential dynamic behavior of the process/system. This is defined by the duration of the period of load oscillation (up to 18 seconds for the crane observed). Experiments have shown that 10 seconds are sufficient for the optimization horizon.

The reference prediction w(t) for the position, velocity and acceleration of the load is generated from the hand lever signals of the crane operator (desired velocities). The prediction considers reductions in velocity, when the load approaches the limits of the working range.

The model-predictive trajectory generation considers restrictions for the process variables as restrictions of the optimal control problem.

$$u_{lin,min} \leqq u_{lin} \leqq u_{lin,max} \tag{17}$$

$$y_{lin,min} \leqq y_{lin} \leqq y_{lin,max}$$

Restrictions of the change of the input are used to avoid high-frequency excitations of the system.

$$\dot{u}_{lin,min} \leqq \dot{u}_{lin} \leqq \dot{u}_{lin,max} \tag{18}$$

Hence, the rates of change $\dot{u}_{lin}$ must be considered as actuating variables when formulating the optimal control problem.

The generation of the reference trajectories leads to an outer control circuit (FIG. 10)). Thus, the results of the stability considerations of model-predictive regulations are applicable. Conditions for the guaranteed stability of the closed-loop control circuit under nominal conditions normally require stabilizing restrictions of the states at the end of the optimization horizon together with an appropriate evaluation of the final state. For a zero-state terminal constraint, fixed final values, which depend on the stationary states in conjunction with the reference inputs, would have to be introduced for the states not to be integrated.

$$x_{lin}(t_f) = x_{lin,f}(w(t_f)) \tag{19}$$

Restrictions of this type (equation (19)) probably cause unsolvable optimal control problems under non-nominal conditions, such as model uncertainties or measurement noise, particularly for short optimization horizons. Thus, the equation restriction (19) is approximated as a square penalty term with symmetrical, positive definite weighting matrix $\overline{Q}$, which extends the original power functional as follows:

$$J = J_c + \frac{1}{2}(x_{lin}(t_f) - x_{lin,f})^T \overline{Q}(x_{lin}(t_f) - x_{lin,f}) \tag{20}$$

B. Numerical Solution of the Optimal Control Problem

The time-continuous, restricted, linear-square optimal control problem (15)-(20) is discretized.

$$t_0 = t^0 \leqq t^1 \leqq \ldots \leqq t^K = t_f$$

$$x_{lin}^{k+1} A^k x_{lin}^k + b^k u_{lin}^k,\ k=0, \ldots, K-1 \tag{21}$$

$$x_{lin}^0 = x_{lin,0}$$

$$y_{lin}^k = C_{lin}^k x_{lin}^k,\ k=0, \ldots, K$$

Wherein $x_{lin}^k$, $u^k$ and $y_{lin}^k$ designate the values of the corresponding variables in the discretization points $t^k$. The matrixes and vectors $A^k$, $b^k$ and $C^k$ are obtained by solving the transition equation in $[t^k, t^{k+1}]$ from A, b and C. The power functional (equation (20)) and the restrictions (equations (17) (18)) likewise are discretized correspondingly.

Thus the time-continuous optimal control problem as an object of quadratic programming is approximated for the state variables and actuating variables $[x_{lin}^k, u_{lin}^k]$ of the discrete problem and can be solved with a usual interior-point algorithm. This algorithm utilizes the structure of the discrete model equations in a RICCATI-like approach, in order to obtain a solution of the NEWTON equation with $O(K(m^3+n^3))$ operations. This means that the calculation effort is increasing linearly with the optimization horizon K and cubically with the number of actuating variables (m) and state variables (n).

Non-equidistant discretization steps $\Delta T^k = t^{k+1} - t^k$ in the prediction horizon of the MPC help to limit the dimension of the optimal control problem. The representation shows that the initial incrementation is determined by the clock rate of trajectory generation and then is increasing linearly within the prediction horizon.

By means of the inventive crane control with the corresponding load oscillation damping, in which data from the two sensor units associated to the respective strands of cables are considered and which is designed as described above, a fast and safe damping of the spherical pendular oscillations of the load with only minimum pendulum deflections can be achieved. This is demonstrated by the following measurement results, which were performed with a cable length of 57 m and a load of 3.5 t.

Figure 11:
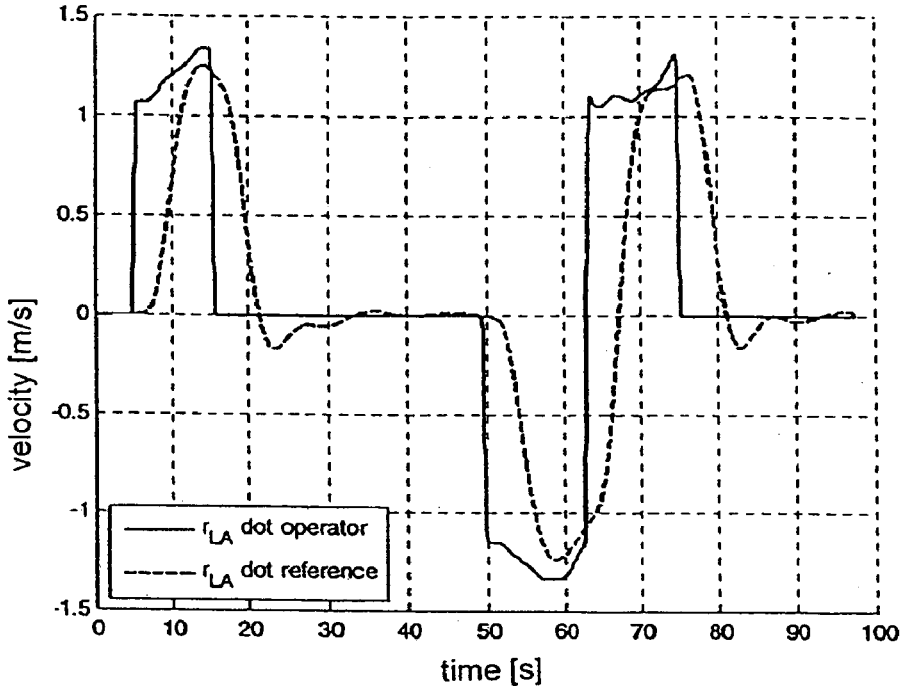
FIG. 11: shows a comparison of the settings of the crane operator with a desired trajectory, which is generated by the path planning module in accordance with the invention.

FIG. 11 shows the velocity of the load, once as specified by the crane operator by means of an input element, and once as specified via the inventive path planning module by means of optimal control as a desired trajectory. The restrictions of the system are not considered here, so that the upper limit for the velocity of the load depends on the radial load position, as the geometries of the boom and of the luffing cylinder permit different maximum velocities with different boom positions. For the maximum acceleration, however, a constant restriction is specified.

Figure 12A:
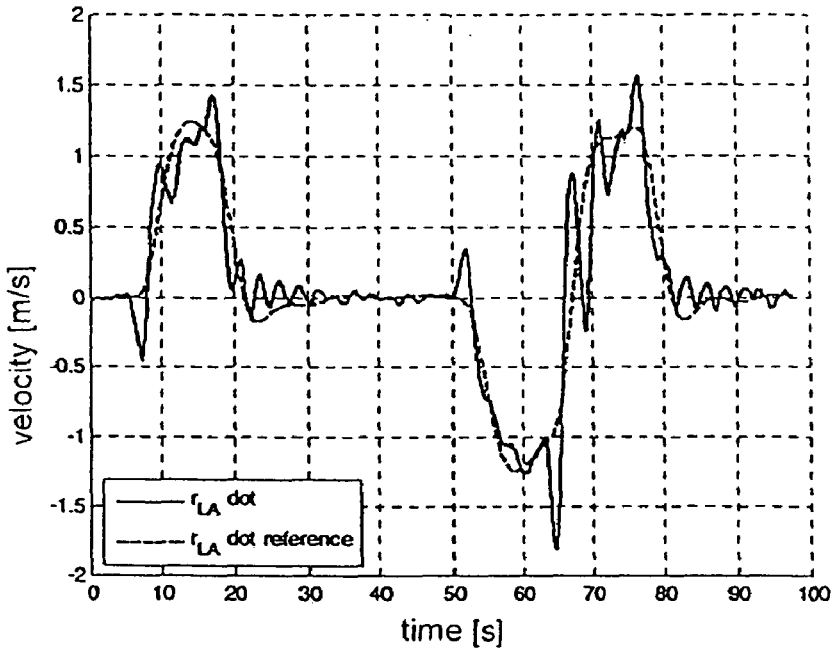
FIG. 12*a*: shows a comparison of a desired trajectory with the actual movement of the load with respect to the load velocity.
Figure 12B:
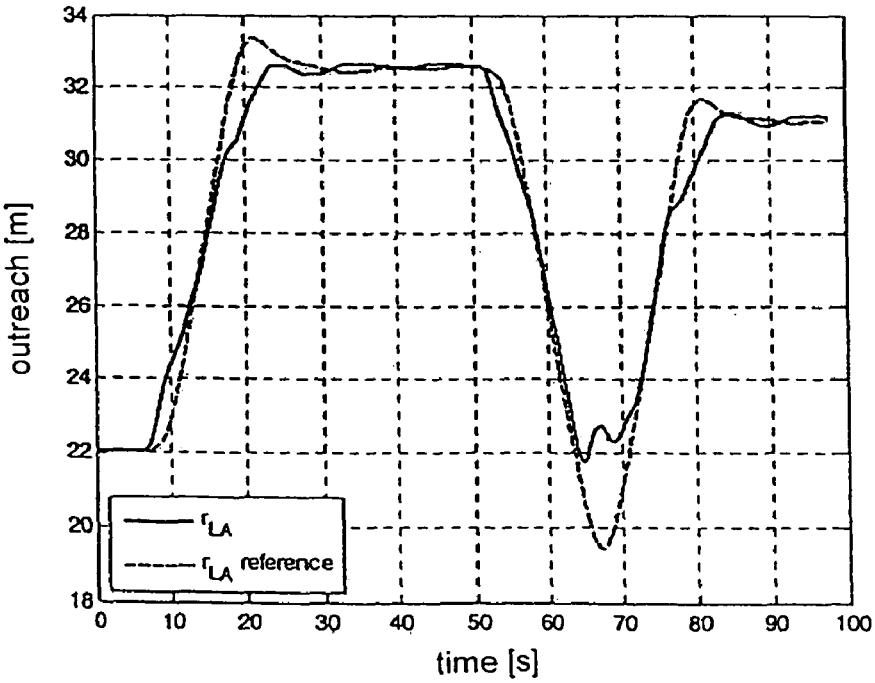
FIG. 12*b*: shows a comparison of a desired trajectory with the actual movement of the load with respect to the load position.

In FIG. 12*a*, this desired trajectory now is compared with the measured velocity of the load. The control in accordance with the invention follows the desired trajectory, wherein the path planning module compensates uncertainties in the model by a model-based path planning. This results in a fast and damped movement of the load without any appreciable overswings. FIG. 12*b* then shows the corresponding trajectory of the load position.

Figure 13:
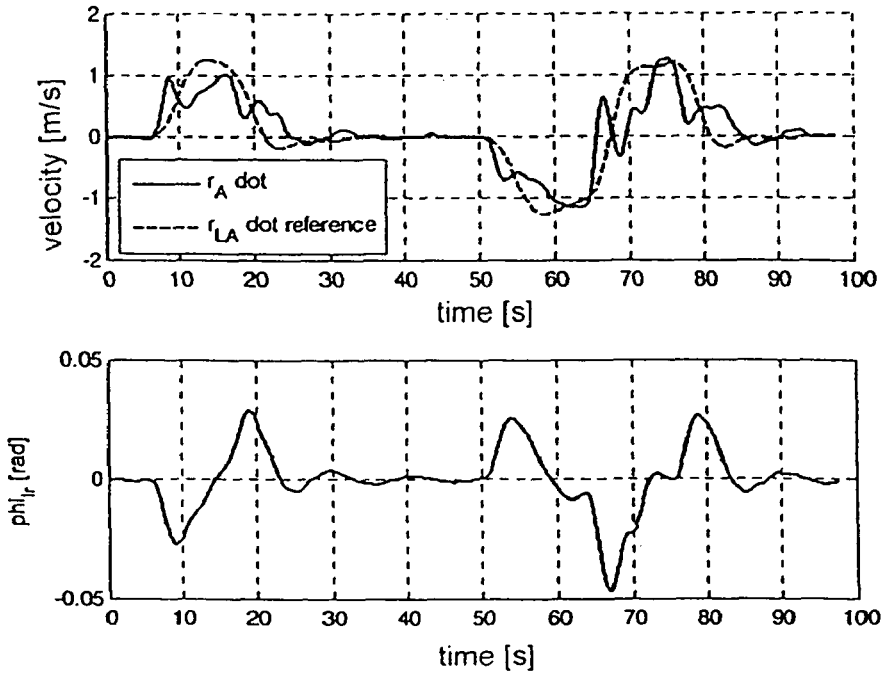
FIG. 13: shows the velocity of the boom head as compared to the desired velocity of the load and the radial cable angle resulting from the movement.

The inventive control is damping the spherical oscillations of the load by corresponding compensating movements of the boom during and at the end of each maneuver. This is shown in FIG. 13, in which the countermovements performed by the boom tip are shown, which counteract the oscillation of the load. As a result, the cable angle can be limited to less than 3°.

Figure 14:
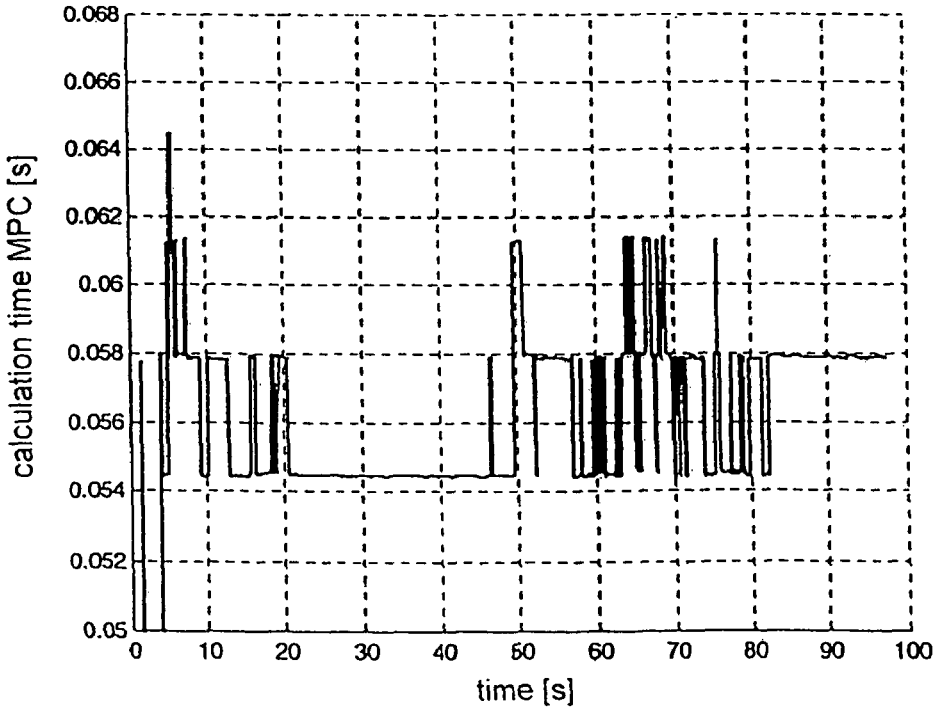
FIG. 14: shows the time which is required for calculating the desired trajectories.

The calculation time required for the online calculation of the optimal solution problem in the path planning module is shown in FIG. 14. There are obtained calculation times between 54 msec and 66 msec. What is decisive for this extremely short response of the path planning to the specifications of the crane operator on the one hand is the fast solvability due to the subsequent linear path of non-linear control and non-linear crane system, and the increasing length of the intervals between the checkpoints of the prediction within the prediction horizon.

The invention claimed is:

1. A crane control of a crane, which includes at least one cable for lifting a load, wherein at least one sensor unit is provided for determining a cable angle relative to the direction of gravitational force, and wherein the sensor unit includes an electric spirit level, wherein beside the sensor unit for determining a cable angle relative to the direction of gravitational force at least one gyroscope unit is provided for measuring a cable angular velocity, wherein the sensor unit and/or the gyroscope unit are arranged on a cable follower, which, via a cardan joint, is connected with a boom of the crane and which is guided on the cable, and wherein the cardan joint enables the cable follower to freely move about a horizontal and vertical axis but inhibits rotary movement.

2. The crane control according to claim 1, wherein said at least one cable includes at least two strands of cables for lifting the load, and at least two sensor units are provided for respectively determining the cable angles of said at least two strands of cables relative to the direction of gravitational force, which are associated to the at least two strands of cables.

3. The crane control according to claim 1, wherein the crane includes at least two strands of cables for lifting the load, and at least two gyroscope units are provided for measuring the cable angular velocities, which are associated to different strands of cables.

4. The crane control according to claim 1, wherein a display unit is provided for indicating a deviation resulting from the measured cable angle, for indicating a cable angle relative to the direction of gravitational force and/or a horizontal deviation of the load resulting therefrom.

5. The crane control according to claim 4, wherein the display optically and/or acoustically indicates a perpendicular cable position.

6. The crane control according to claim 1, wherein a warning means is provided, which warns the crane operator when an admissible range of values for a deviation resulting from the measured cable angle for the cable angle relative to the direction of gravitational force and/or for the horizontal deviation of the load is exceeded by an optical and/or acoustic signal.

7. The crane control according to claim 6, wherein an overload protection is provided which automatically intervenes in the control of the crane when an admissible range of values for a deviation resulting from the measured cable angle for the cable angle relative to the direction of gravitational force and/or for the horizontal deviation of the load is exceeded, to prevent an overload of the crane.

8. The crane control according to claim 7, wherein the overload protection stops the movement of the crane.

9. The crane control according to claim 7, wherein the overload protection at least partly enables the movement of the crane and/or the cable, in the case of off-shore cranes.

10. The crane control according to claim 7, wherein the crane control, the warning means and/or the overload protection, additionally evaluates data of a cable force sensor.

11. The crane control according to claim 1, wherein the crane includes at least two strands of cables for lifting the load, whose cable field twisting is determined.

12. The crane control according to claim 11, wherein a display unit is provided for indicating the cable field twisting.

13. The crane control according to claim 11, wherein warning means is provided, which warns the crane operator when an admissible range of values for the cable field twisting is exceeded, by an optical and/or acoustic signal.

14. The crane control according to claim 1, wherein an antitwist protection is provided, which automatically intervenes in the control of the crane when an admissible range of values for the cable field twisting is exceeded.

15. The crane control according to claim 1, which includes an automatic load oscillation damping.

16. The crane control according to claim 15, wherein the load oscillation damping is based on the data of at least one gyroscope unit.

17. The crane control according to claim 16, wherein the sensor unit for determining the cable angle relative to the direction of gravitational force is used for monitoring and/or calibrating the gyroscope unit.

18. The crane control according to claim 1, wherein a function for automatically aligning the crane is provided, by means of which the cable is perpendicularly aligned over the load.

19. The crane control according to claim 1, wherein a function for automatically aligning the crane is provided, by means of which a cable field twisting is compensated.

20. The crane control according to claim 1, comprising a memory for storing load data on the basis of the cable angle for service life calculation and/or for documentation.

21. A crane control of a crane, which includes at least one cable for lifting a load, wherein at least one sensor unit is provided for determining a cable angle relative to the direction of gravitational force, and wherein the sensor unit includes an electric spirit level, wherein the sensor unit is arranged on a cable follower, which via a cardan joint is connected with a boom of the crane and which is guided on the cable, wherein the cardan joint enables the cable follower to freely move about a horizontal and vertical axis but inhibits rotary movement.

22. The crane control according to claim 21, wherein the crane includes at least two strands of cables for lifting the load, and at least two cable followers are provided, which are associated to different strands of cables.

23. A crane control for driving the positioners of a crane which includes at least one first and one second strand of cables for lifting the load, comprising a load oscillation damping for damping spherical pendular oscillations of the load, wherein first and second sensor units are provided, which are associated to the first and second strands of cables, in order to determine the respective cable angles and/or cable angular velocities, and the load oscillation damping includes a control in which the cable angles and/or cable angular velocities determined by the first and second sensor units are considered, wherein the first and second sensor units each comprise a gyroscope unit, each sensor unit being arranged on a cable follower, which, via a cardan joint, is connected with a boom of the crane and which is guided on the cable, and wherein the cardan joint enables the cable follower to freely move about a horizontal and vertical axis but inhibits rotary movement.

24. The crane control according to claim 23, wherein the cable followers each are connected with the boom of the crane via a cardan joint and follow the movement of the strand of cables to which they are associated.

25. The crane control according to claim 23, wherein the data measured by the first and second sensor units are evaluated by first and second observer circuits.

26. The crane control according to claim 23, wherein a compensation of the data measured by the first and second sensor units is effected with respect to the mounting angle of the sensor units and the slewing angle of the crane.

27. The crane control according to claim 23, wherein sensor errors are detected by a comparison of the data measured by the first and second sensor units.

28. The crane control according to claim 23, wherein torsional oscillation of the cable field is considered in the load oscillaton damping by forming an average from the cable angles and/or cable angular velocities determined by the first and second sensor units.

29. The crane control according to claim 23, wherein the crane control is non-linear.

30. The crane control according to claim 23, wherein the crane control is based on the inversion of a physical model of the movement of the load in dependence on the movements of the positioners.

31. The crane control according to claim 23, wherein the load oscillation damping comprises a path planning module, which specifies desired trajectories for the crane control.

32. The crane control according to claim 31, wherein a current system status of the crane including a boom position and/or the cable angles and/or cable angular velocities are determined by the first and second sensor units are included in the path planning module as input variables.

33. The crane control according to claim 31, wherein the path planning module considers restrictions of the crane control when generating desired trajectories.

34. The crane control according to claim 31, wherein the path planning module comprises an optimal control for generating the desired trajectories.

35. The crane control according to claim 31, wherein the path planning module employs an increasing length of the calculation intervals for a prediction within a time horizon.

36. The crane control according to claim 23, wherein a position and a velocity of a boom head are considered in the control of the load oscillation damping.

37. The crane control according to 23, with at least one sensor unit provided for determining a cable angle relative to the direction of gravitational force.

38. A crane for lifting a load, comprising positioners for moving the crane and the load, and comprising a crane control for driving the positioners, wherein the crane control includes a load oscillation damping for damping spherical pendular oscillations of the load, and wherein the crane includes at least two strands of cables for lifting the load, two sensor units are provided, which are associated to the two strands of cables, in order to determine the respective cable angles and/or cable angular velocities, and the load oscillation damping includes a control in which the cable angles and/or cable angular velocities determined by the two sensor units are considered wherein the sensor units are arranged on a cable follower, which, via a cardan joint, is connected with a boom of the crane and which is guided on the cable, and wherein the cardan joint enables the cable follower to freely move about a horizontal and vertical axis but inhibits rotary movement.

39. The crane according to claim 38 with at least one sensor unit provided for determining a cable angle relative to the direction of gravitational force.

40. The crane according to claim 38 with a slewing gear for slewing the crane and/or a luffing gear for luffing up a boom, which are driven by the crane control.

* * * * *